United States Patent [19]

Schellstede et al.

[11] Patent Number: 4,928,757

[45] **Date of Patent: * May 29, 1990**

[54] HYDRAULIC WELL PENETRATION APPARATUS

[75] Inventors: Herman J. Schellstede, New Iberia, La.; Robert W. McQueen, Houston; Alan D. Peters, Katy, both of Tex.

[73] Assignee: Penetrators, Inc., Houston, Tex.

[ * ] Notice: The portion of the term of this patent subsequent to Nov. 22, 2005 has been disclaimed.

[21] Appl. No.: 279,648

[22] Filed: Dec. 5, 1988

Related U.S. Application Data

[63] Continuation-in-part of Ser. No. 42,191, Apr. 24, 1987, Pat. No. 4,790,384.

[51] Int. Cl.[5] ..... E21B 43/112; E21B 7/18

[52] U.S. Cl. ..... 166/55.1; 166/55.3; 166/223; 175/78; 175/79

[58] Field of Search ..... 166/298, 55.3, 223, 166/383, 55.1, 55.2; 175/62, 67, 78–80, 77, 267, 286; 92/110, 111; 91/196; 137/106; 251/337

[56] References Cited

U.S. PATENT DOCUMENTS

| | | | |
|---|---|---|---|
| Re. 29,021 | 11/1976 | Archibald et al. | 175/213 |
| 1,495,949 | 5/1924 | Carroll | 92/110 |
| 2,018,285 | 10/1935 | Schweitzer et al. | 166/223 X |
| 2,258,001 | 10/1941 | Chamberlain | 175/67 |
| 2,271,005 | 1/1942 | Grebe | 166/50 X |
| 2,345,816 | 4/1944 | Hays | 175/67 X |
| 2,426,106 | 8/1947 | Kinley | 166/55.1 |
| 2,699,921 | 1/1955 | Garrison | 175/267 |
| 2,707,616 | 5/1955 | Schad et al. | 175/61 X |
| 2,743,703 | 5/1956 | Miller | 92/110 X |
| 2,758,653 | 8/1956 | Desbrow | 166/73 |
| 2,796,129 | 6/1957 | Brandon | 166/50 X |
| 2,838,117 | 6/1958 | Clark, Jr. et al. | 166/283 |
| 2,852,230 | 9/1958 | Garrison | 175/78 X |
| 3,130,786 | 4/1964 | Brown et al. | 166/55 |
| 3,145,776 | 8/1964 | Pittman | 166/55 |
| 3,202,062 | 8/1965 | Burden | 92/111 X |
| 3,301,337 | 1/1967 | Vaughn et al. | 166/298 X |
| 3,318,395 | 5/1967 | Messner | 166/223 X |
| 3,370,887 | 2/1968 | Knutson et al. | 299/4 X |
| 3,400,980 | 9/1968 | Dahms et al. | 299/5 |
| 3,402,965 | 9/1968 | Dahms et al. | 299/4 |
| 3,402,967 | 9/1968 | Edmonds et al. | 299/5 |
| 3,511,133 | 5/1970 | Day | 92/110 X |
| 3,547,191 | 12/1970 | Malott | 166/223 |
| 3,873,156 | 3/1975 | Jacoby | 299/4 |
| 4,022,279 | 5/1977 | Driver | 166/271 |
| 4,050,529 | 9/1977 | Tagirov et al. | 175/424 |
| 4,134,453 | 1/1979 | Love et al. | 166/298 |
| 4,257,484 | 3/1981 | Whitley et al. | 166/321 X |
| 4,317,492 | 3/1982 | Summers et al. | 175/79 |
| 4,346,761 | 8/1982 | Skinner et al. | 166/206 |
| 4,365,676 | 12/1982 | Boyadjieff et al. | 175/61 |
| 4,640,362 | 2/1987 | Schellstede | 175/78 X |
| 4,790,384 | 12/1988 | Schellotede et al. | 166/55.3 X |

FOREIGN PATENT DOCUMENTS

| | | | |
|---|---|---|---|
| 747985 | 7/1980 | U.S.S.R. | 175/77 |
| 883350 | 11/1981 | U.S.S.R. | 166/55 |

*Primary Examiner*—Hoang C. Dang

*Attorney, Agent, or Firm*—Mason, Fenwick & Lawrence

[57] ABSTRACT

A well casing penetrator includes an elongated housing having a work fluid input chamber and enclosing an outwardly movable hydraulic cylinder driven punch for cutting an opening in a casing. A high pressure liquid jet nozzle is mounted on the end of a lance-like hose having a nozzle on its outer end which is moved outwardly or inwardly through an axial bore in the punch by a lance drive piston and cylinder assembly with outward movement serving to cut a radially extending opening in the surrounding earth. A moveable valve spool is connected to a coil compression spring which urges the spool toward a first position in the spool directs work fluid to hydraulic punch cylinder and lance drive piston and cylinder assembly so that the punch and lance-like hose are maintained in retracted position. When the pressure in the work fluid input chamber is increased beyond a critical pressure, the force of the spring is overcome and the valve spool shifted to direct work fluid to cause the punch cylinder and the lance drive piston cylinder and cylinder assembly to be activated to extend the punch and lance-like hose while simultaneously supplying high pressure fluid to the lance-like hose and nozzle to initiate a penetration operation. The parts return to their original retracted position upon lowering of the work pressure below the critical pressure.

28 Claims, 16 Drawing Sheets

HYDRAULIC WELL PENETRATION APPARATUS

CROSS REFERENCE TO RELATED APPLICATION

This application is a continuation-in-part of earlier application Ser. No. 07/042,191, filed Apr. 24, 1987, now U.S. Pat. No. 4,790,384.

BACKGROUND OF THE INVENTION

The present invention is in the field of oil and/or gas well casing perforation apparatus, procedures and methods. More specifically, the present invention is directed to a unique apparatus and method employing a high pressure fluid driven punch for cutting an opening in a well casing and subsequently cutting a passageway through the surrounding earth by the use of a high pressure jet for a substantial distance outwardly beyond the casing for permitting the flow of liquid or gaseous hydrocarbons into the casing.

The vast majority of oil and gas wells are drilled by the use of rotary drilling procedures in which drilling mud containing extremely fine particles is forced downwardly through the drilling string and out through the bit for the removal of cuttings, cooling and other beneficial results. A commonly employed material in drilling mud comprises extremely small particles of barite. It has been found that the earth surrounding a drill bore is contaminated outwardly by the drilling fluid for a distance of a meter or more beyond the bore. This contamination, being largely formed of minute particles from the mud, frequently presents a substantial barrier to the inflow of hydrocarbons to the well casing.

Moreover, invasion of the formation by cementing and well completion fluids creates additional formation contamination. The zone around a well bore which has been contaminated or plugged by drilling fluid, cement or completion fluids is termed the invaded zone or damaged zone and the effect is called formation damage, skin damage or skin effect. "Skin effect" is a petroleum engineering measure of the extent of damage or resistance to flow of fluids around a well bore and is expressed as a dimensionless number. A high skin effect number or factor representing extensive formation damage for example would be 10, whereas a low skin effect number would be 0.

A number of expedients have been proposed and employed in an effort to provide flow passageways through the surrounding strata or to remove skin effect for permitting and increasing the flow of hydrocarbons into the well casing. Probably the most common expedient is the use of projectiles fired from gun-like devices positioned in the casing; however, the projectiles from such devices are normally incapable of penetrating beyond the zone of contamination and optimum flow conditions consequently cannot normally be achieved by the use of such devices. Consequently, a variety of other proposals for penetrating the surrounding strata have come forward. For example, U.S. Pat. No. 4,022,279 proposed a method of boring spiral bores a substantial distance outwardly from a well casing for increasing production. However, this patent does not disclose a specific apparatus for effecting the desired spiral bores and it is not certain that such structure actually exists.

U.S. Pat. No. 3,370,887 discloses a fracturing device employing a blow-out plug 11 which is blown radially outwardly through the well casing by high pressure injected into the housing in which the plug is mounted. U.S. Pat. Nos. 3,400,980 and 3,402,965 (both to Dahms et al.) both disclose a tool which is moved downwardly out the lower end of the well casing and from which extendible pipe or hose members more outwardly while discharging high pressure liquid to provide a cavity at the lower end of the well. U.S. Pat. No. 3,402,967 (Edmunds et al.) discloses a device that is similar in operation to the Dahms et al patents.

U.S. Pat. No. 3,547,191 (Malott) discloses an apparatus that is lowered into a well for the discharge of high pressure liquid through nozzle means 26, 27. The discharge from the nozzle means passes through previously formed openings 35 in the casing.

U.S. Pat. No. 3,318,395 (Messmer) discloses a tool including a body of solid rocket propellant fuel 34 which is lowered to a desired position in a well. The rocket fuel is ignited and the exhaust discharges outwardly through nozzle means 36 to cut through the casing and the cement surrounding the casing. The discharge from the rocket includes abrasive particles which aid in the cutting operation and also serve to cut as notch in the surrounding formation to fracture same and hopefully improve production. However, as the discharge from the rocket, or any other fixedly positioned jet means, erodes the formation, the standoff distance between the nozzle and the formation increases and the effectiveness of the apparatus is greatly reduced.

U.S. Pat. No. 4,050,529 (Tagirov et al.) discloses a tool which is lowered down a well casing and includes nozzle means through which high pressure abrasive containing water is pumped to cut through both the casing and the surrounding formation. The use of abrasive materials pollutes the well forever in that it creates monumental wear problems in valves, pumps and the like subsequently used with the well. Moreover, the abrasive is absorbed in the surrounding formation and also blocks the pores of the formation.

U.S. Pat. No. 4,346,761 (Skinner et al.) discloses a system including nozzles 20 mounted for vertical up and down movement in the casing to cut slots through the casing. The nozzle means does not protrude beyond the casing. However, the high pressure jet discharged from the nozzle would apparently effect some cutting of the surrounding strata.

Other patents disclosing high pressure nozzles for cutting well casing include U.S. Pat. No. 3,130,786 (Brown et al.); U.S. Pat. No. 3,145,776 (Pitman) and U.S. Pat. No. 4,134,453 (Love et al.). U.S. Reissue Pat. Re. No. 29,021 (Archibald) discloses an underground mining system employing a radial jet which remains in the well before for cutting the surrounding formation. U.S. Pat. No. 4,317,492 (Summers) discloses a high pressure water jet-type well system usable in mining and drilling operations in which a nozzle providing a jet is moved out the bottom of the well and is then moved radially. U.S. Pat. No. 3,873,156 (Jacoby) also discloses a jet-type mining device movable out the lower end of a well for forming a cavity in a salt well. U.S. Pat. No. 4,365,676 (Boyadjieff) discloses a mechanical drilling apparatus moveable radially from a well for effecting a lateral bore hold. A number of additional U.S. patents disclose the employment of high pressure nozzle means for cutting the strata adjacent or at the bottom of a well with these patents including U.S. Pat. Nos. 2,018,285;

2,258,001; 2,271,005; 2,345,816; 2,707,616; 2,758,653; 2,796,129 and 2,838,117.

None of the aforementioned prior art devices have achieved any substantial degree of success due to a variety of shortcomings. For example, those devices which simply project a high pressure jet from a nozzle positioned inside the casing cannot cut outwardly from the casing a sufficient distance to be truly effective. Moreover, the direction and extent of the cut provided by such devices is subject to a number of variable parameters including the nature of the surrounding formation and it is therefore difficult to achieve a predictable result. One problem with all high pressure-type jet devices operating through the wall of the well casing is that an aperture must be cut in the casing and the surrounding cement as a prerequisite to cutting through the surrounding formation. In some of the prior known devices the aperture can be cut with the nozzle jet itself whereas other devices require the use of separate mechanical cutting means. Those devices using nozzle jets for cutting the casing suffer from a very serious drawback in that the cutting liquid frequently includes abrasive particles which remain in the casing and can subsequently adversely effect valves or other components such as pumps or the like into which some of the abrasive components are eventually indicated.

The use of separate mechanical cutting devices suffers from the shortcoming of requiring substantial additional expense both in terms of the cost of the extra equipment and the cost of time required in using same for cutting the casing. This is true because such use will normally require lowering of the cutting device to the bottom of the well, cutting of the casing and subsequent removal of the cutting device and positioning of the jet means in the casing prior to usage of the nozzle jet-type cutter. The positioning and removal of tools from the well normally requires a time consuming and expensive pulling and replacement of the string.

A common shortcoming of all types of penetrators prior to the invention of U.S. Pat. No. 4,640,362 (Schellstede) was that they simply did not result in adequate penetration of the formation outwardly of the casing a sufficient distance to achieve improved production. Therefore, there had been a very substantial need for apparatus capable of effectively penetrating the earth formation surrounding a well casing for a distance outwardly beyond the casing outside the contamination zone surrounding the casing. A particular problem was the inability of many devices prior to Schellstede to maintain a proper standoff distance from a cutting jet providing means.

The invention of the aforementioned Schellstede patent represented a very significant advance in the penetration art in that it permitted penetration of the earth formation well beyond the contamination zones surrounding the casing as to provide a very superior performance compared to the prior known devices. Additionally, it permitted an initial jetting of cement away from the casing prior to outward movement of the jet providing semi-rigid, extendable, conduit and nozzle extension device. Moreover, the Schellstede device had other advantageous features flowing from its unique design. However, the device of the Schellstede patent is somewhat complicated in requiring hydraulic circuitry which includes two nitrogen accumulators, rotor actuators and valve sets and tubing flow lines all of which were mounted in a ten foot housing. Additionally, operation of the Schellstede device requires that pressurized working fluid be provided to the apparatus at four different pressures each at different times during each cycle of operation. The overall length of the complete apparatus is consequently substantial and the use of the flow lines creates a substantial potential for leakage in view of the high pressure required during usage of the apparatus.

Prior U.S. Pat. No. 4,790,384 represented an improvement over the device of the aforementioned U.S. Pat. No. 4,640,362 in that it used only a single accumulator and was less complicated and more trouble free. However, the invention of the aforementioned application still included complexities such as those resultant from the use of the single accumulator in the control head which rendered the apparatus somewhat time consuming to calibrate and use for some applications. Also, the device of the prior application required the expensive boring of lengthy bores through solid steel as part of the construction of the control portion of the apparatus.

It is consequently the primary object of the present invention to provide a new and improved apparatus for penetrating earth formations around a well casing which is less complicated, easier to use, less expensive to machine and more trouble free than the prior known well penetration devices.

Another object of the invention is the provision of a simplified control head for a lance-type well penetrator.

SUMMARY OF THE INVENTION

The preferred embodiment of the invention comprises an elongated generally cylindrical housing having a control means including a coil compression spring means for positioning a movable control valve spool in a first position of operation so as to provide a smaller, cheaper and more reliable control assembly for controlling the remaining operative downhole components of the preferred embodiment. The remaining operative components include cam drive cylinder means for driving a wedging cam to extend a radially movable punch outwardly through the casing of a well. An extendable semi-rigid, extendable conduit and nozzle extension device or "lance" which has a nozzle at its outer end is positioned to move axially outward through an axial bore in the punch so that it provides a small additional force outwardly on the casing. After the punch penetrates the casing, the nozzle moves outwardly beyond the casing to provide a bore extending outwardly through the formation from the opening provided in the casing. The operation of the nozzle during the initial opening movement of the casing outwardly by the punch serves to wash out and remove cement or other material that is adjacent the casing so as to permit the punch to more quickly effect the provision of the opening in the casing. The moveable control valve spool is provided in a cylindrical housing for axial reciprocation between first and second positions and is normally urged to a first position by the coil compression spring in which it directs working fluid to a lance drive cylinder connected to the lance for moving the lance to and from its extended position. Also, working fluid at a relatively low pressure is directed by the movable valve spool member to the punch cam drive cylinder to position it in either an extended or retracted position.

While means for providing the control functions are taught in U.S. Pat. Nos. 4,790,384 and 4,640,362, the present invention employs different, smaller, and less bulky control means for effecting these functions. After the tool is lowered down the casing to a desired position, but prior to beginning a penetration operation, the movable valve spool member is in a first or "retract" position as a consequence of working fluid being supplied at a pressure that is less than a critical pressure. A penetration operation is initiated by increasing the pressure of the working fluid to a value exceeding the critical pressure. The working fluid is then at a sufficiently high pressure to overcome the force exerted by the coil compression spring on the moveable valve spool so that the movable valve spool is moved by the pressure of the working fluid to a second or "extend" position. The shifting movement of the moveable valve spool to its second position results in the direction of working fluid to the lance drive cylinder and the punch drive cam cylinder so that these cylinders are actuated to essentially simultaneously extend the punch outwardly and move the lance and nozzle outwardly through the punch while simultaneously supplying working fluid at a high pressure through the lance. The working fluid in the lance flows through the nozzle and initially impinges on the interior of the casing in the area being punched by the punch to create a small additional force on the casing area to slightly speed up the failure of the casing area engaged by the punch and to permit the working fluid to immediately flow outwardly into the formation as soon as a crack develops in the casing area contacted by the punch. Consequently, the cement and earth formation is eroded away behind the casing area so as to permit an easy deflection outwardly of side tabs of the casing resultant from the punch movement. After the opening is completed, the lance continues outwardly with the nozzle discharging into the formation to provide an opening extending outwardly several feel beyond the casing so as to enable subsequent enhanced production of the well. When the penetration operation is completed, the pressure is permitted to return to its lower level so that the piston spool assembly shifts back to its first position to cause the lance drive cylinder and the punch cam cylinder to return to their initial positions so that the punch and the lance are retracted back in to the housing of the apparatus.

FIG. **22*a*** is a sectional view of the upper control section of the invention.

FIG. **22*b*** is a sectional view of the lower control section of the invention.

DESCRIPTION OF THE PREFERRED EMBODIMENT

Figure 1:
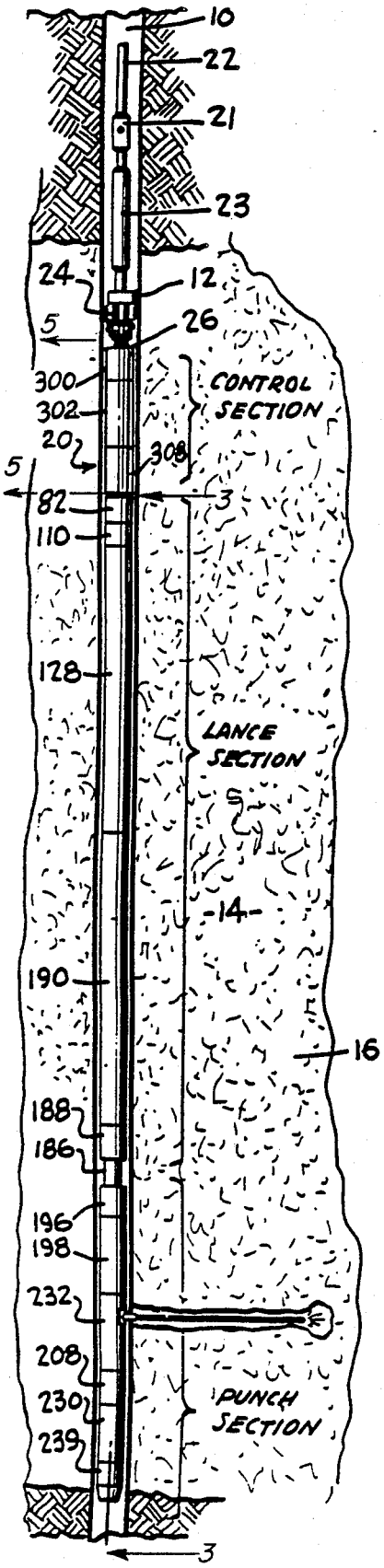
FIG. 1 is a side elevation view illustrating a gas or oil well in vertical section and in which the preferred embodiment of the present invention is being used for perforating the casing and surrounding formation.

Attention is initially invited to FIG. 1 of the drawings which illustrates the employment of the preferred embodiment of the invention in a well 10 having a casing 12 extending downwardly through an oil, gas or water bearing strata 14. An invaded zone 16 extends outwardly forced into the strata during the drilling operation. Additionally, the area immediately surrounding the casing will normally be cemented to provide a cement blanket surrounding the casing at the completion of the well.

The present invention comprises an elongated downhole apparatus 20 suspended from the surface by a pipe string 22 comprising a plurality of conventional tubular pipe sections with the lowermost pipe section being connected to a circulating valve 21, a filter 23 and a stabilizer/anchor 24 of conventional construction which includes selectively operable means expandable outwardly for engagement with the inner wall of casing 12 to anchor the stabilizer/anchor in fixed position. The upper end of elongated apparatus 20 is supported from stabilizer/anchor 24 by a threaded connection 26.

The upper above-ground end of the string 22 is connected as shown in FIG. 1 of the Schellstede patent to a swivel supported by conventional means of a workover rig or the like and is connected to low pressure hose means and high pressure hose means to sources of pressurized work fluid which is usually water. The hose members extend from a vehicle which has a console control panel. Additionally, the vehicle includes a motor driving conventional high pressure and low pressure pump means connected to the hose member and controlled from the console control panel. The pumps receive work fluid from a suction line extending from a conventional two-state element filter assembly which receives the unfiltered working fluid from a tank truck and filters out all particles greater than 20 microns in size. However, even finer filters can be used. The high pressure pump is an acid service trimmed five piston positive displacement pump which provides a low frequency pulsating output, the frequency of which can be adjusted. Pumps with a different number of cylinders could also be employed.

The elongated downhole apparatus 20 is formed of a plurality of connected tubular housing members in which various functions and equipment are provided. The housing function providing housing sections from top to bottom as illustrated in FIG. 1 include a control section, a lance section and a punch section as shown.

The control section is best illustrated in FIGS. 5, 6, 22A and 22B and includes an axis A extending along its length. A threaded sub 300 is threaded on the lower end of the short tube section 26 of the invention disclosed in U.S. Pat. No. 4,790,384 and the interior of sub 300 constitutes a work fluid input means. Sub 300 supports a threaded cylindrical housing 302 threaded on its lower end by means of upper internal threads 304. Lower internal threads 306 of housing 302 are threadably connected to the upper end of a valve housing cylinder 308.

A cylindrical bore 310 in the threaded cylindrical housing 302 is positioned between the upper and lower internal threads 304 and 306 and defines a spring chamber in which a heavy duty coil compression spring 312 is positioned. The upper end of coil compression spring 312 engages the lowermost one of a pair of brass washers 314 which are axially positioned over a threaded connector 316 having an axial bore 318 at its upper end communicating with an axial bore 320 of slightly less diameter. Axial bore 320 in turn communicates at its lower end with a larger diameter bore 330 having internal threads 332 into which the upper end of a moveable valve spool member 334 having an axial valve bore 335 is threadably received. The uppermost one of the brass washers 314 engages the lower radial end surface 333 of a loading nut 336 which is threaded on external threads 338 on the upper end of threaded connector 316; adjustment of loading nut 336 varies the amount of compression of spring 312 and likewise varies the amount of force exerted by the spring so as to vary the critical pressure in the interior of sub 300 required to overcome the force of spring 312 to shift the valve spool member from its FIG. 5 position to its FIG. 6 position to initiate a penetration operation. A lock nut 340 is also threaded on the threads 338 for holding the loading nut 336 in its adjusted position.

The lower end of coil compression spring 312 engages a stop ring 342 which is urged downwardly against the upper end of the valve housing cylinder 308 by spring 312. It should be observed that there is a clearance space between the outer surface of moveable valve member 334 and a cylindrical bore 344 provided in fixed stop ring 342. It should also be noted that the stop ring 342 is bolted to the upper end of valve housing cylinder 308 by bolt means(not shown).

Figure 5:
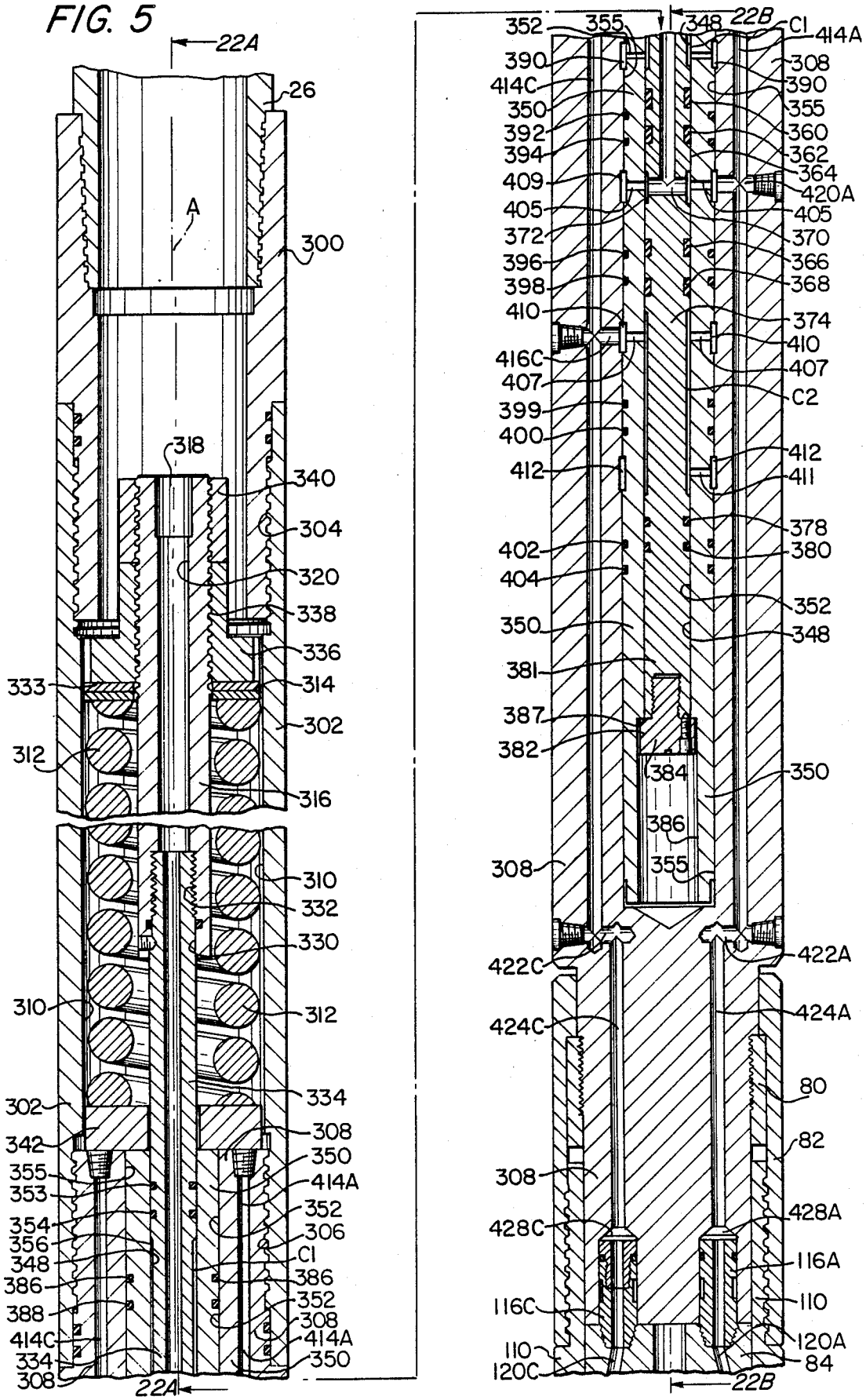
FIG. 5 is a sectional view of the control section taken along lines 5—5 of FIG. 4 illustrating the valve spool in a nonactivated "punch retract" position.

The moveable valve spool member 334 is mounted for axial movement in an axial bore 348 of a valve body sleeve 350 mounted coaxially in an axial bore 352 of the valve housing cylinder 308. Moveable valve spool member 334 includes an upper larger diameter spool portion in which seal means 353 and 354 are mounted for contact with bore 348 of valve body sleeve 350 as shown in FIG. 5. An upper reduced diameter spool portion 356 is provided immediately below larger diameter portion which in conjunction with bore 348 in body sleeve 350 defines an upper moveable cylindrical shaped chamber C1. Seal means 360, 362 engaging bore 348 (FIGS. 5,6) are provided on an upper portion of a central larger diameter spool portion 364 of moveable valve member 334 immediately below reduced diameter spool portion 356. Thus, moveable upper chamber C1 is sealed at its upper end by seals 353, 354 and at its lower end by seals 360, 362.

Figure 6:
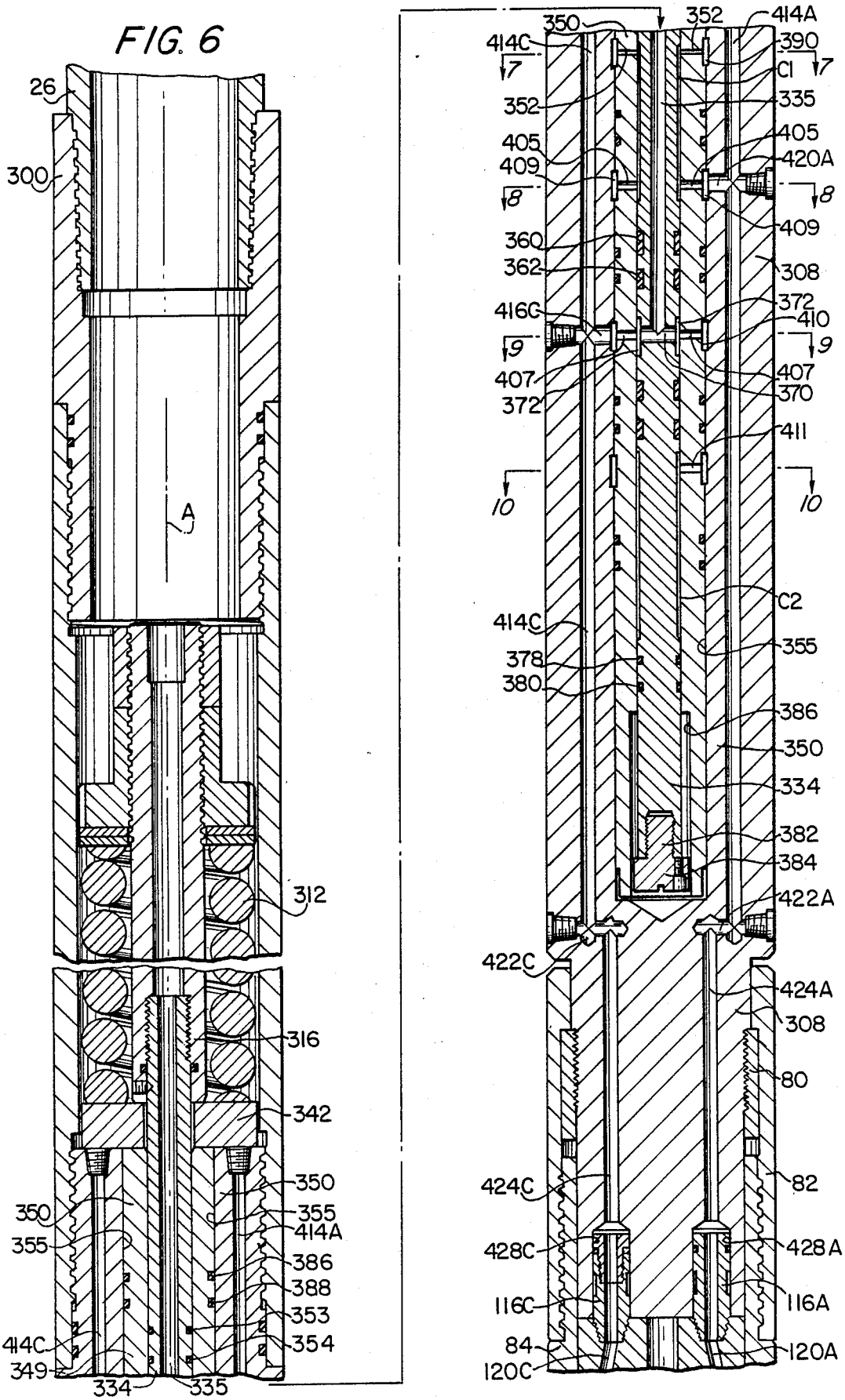
FIG. 6 is a sectional view similar to FIG. 5 but illustrating the valve spool in an activated "punch extend" position assumed during a penetration operation.
Figure 9:
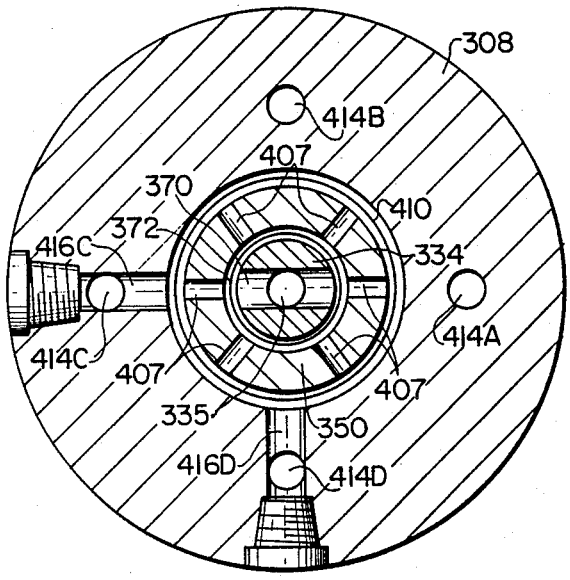
FIG. 9 is a sectional view taken along lines 9—9 of FIG. 6.

Additionally, the lower end of the central larger diameter spool portion 364 is provided with seal means 366, 368. It should also be noted that a transverse bore 370 extends diametrically through the axis of moveable valve member 334 and spool bore 335 at a location between seal means 362 and 366 as shown in FIGS. 5 and 6. Seal means 360, 362, 366 and 368 are formed of polyetheretherketone (PEEK) and all of the other seals are rubber O-rings. The outer ends of transverse bore 370 communicates with an annular chamber groove 372 which is formed in and encircles the outer periphery of valve spool member 334 as best shown in FIG. 9. A lower reduced diameter spool portion 374 is provided in the outer surface of moveable valve spool member 334 below seal means 368 and cooperates with bore 348 to define a second moveable chamber C2. Seal means 378, 380 is provided in a lower large diameter spool portion 381 of valve spool member 334 below the lower reduced diameter portion 374.

A stop member 382 is threaded into the lower end of moveable valve member 334 and has a head portion 384 of greater diameter than the outer diameter of the lower large diameter portion 381 of valve member 334. Head portion 384 is positioned in an internal lower end chamber defined by bore 386 in valve body sleeve 350. A radial shoulder 387 joining bores 348 and 386 defines a stop which engages the upper surface of head portion 384 to limit upward movement of movable valve spool member 334.

Figure 7:
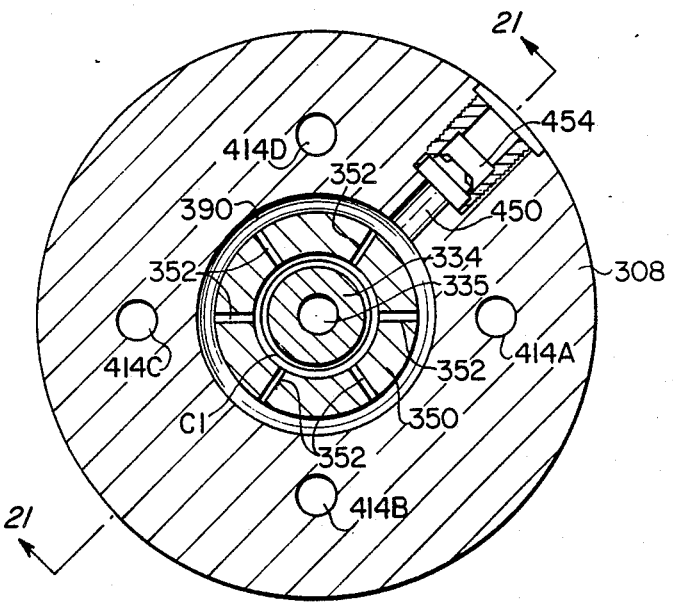
FIG. 7 is a sectional view taken along lines 7—7 of FIG. 6.
Figure 10:
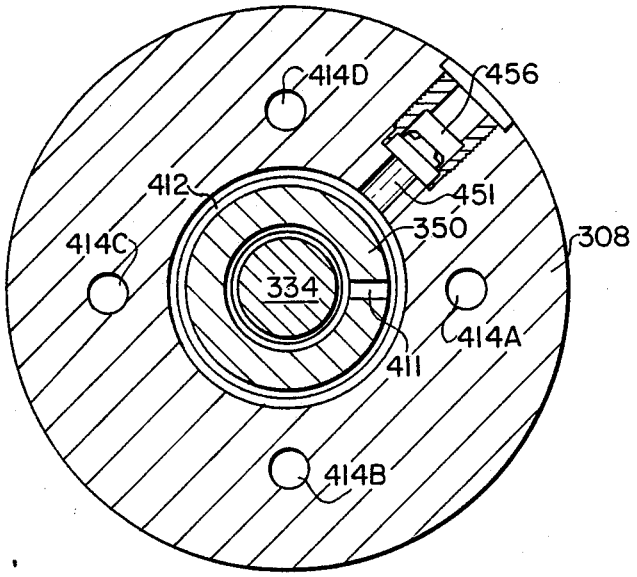
FIG. 10 is a sectional view taken along lines 10—10 of FIG. 6.
Figure 21:
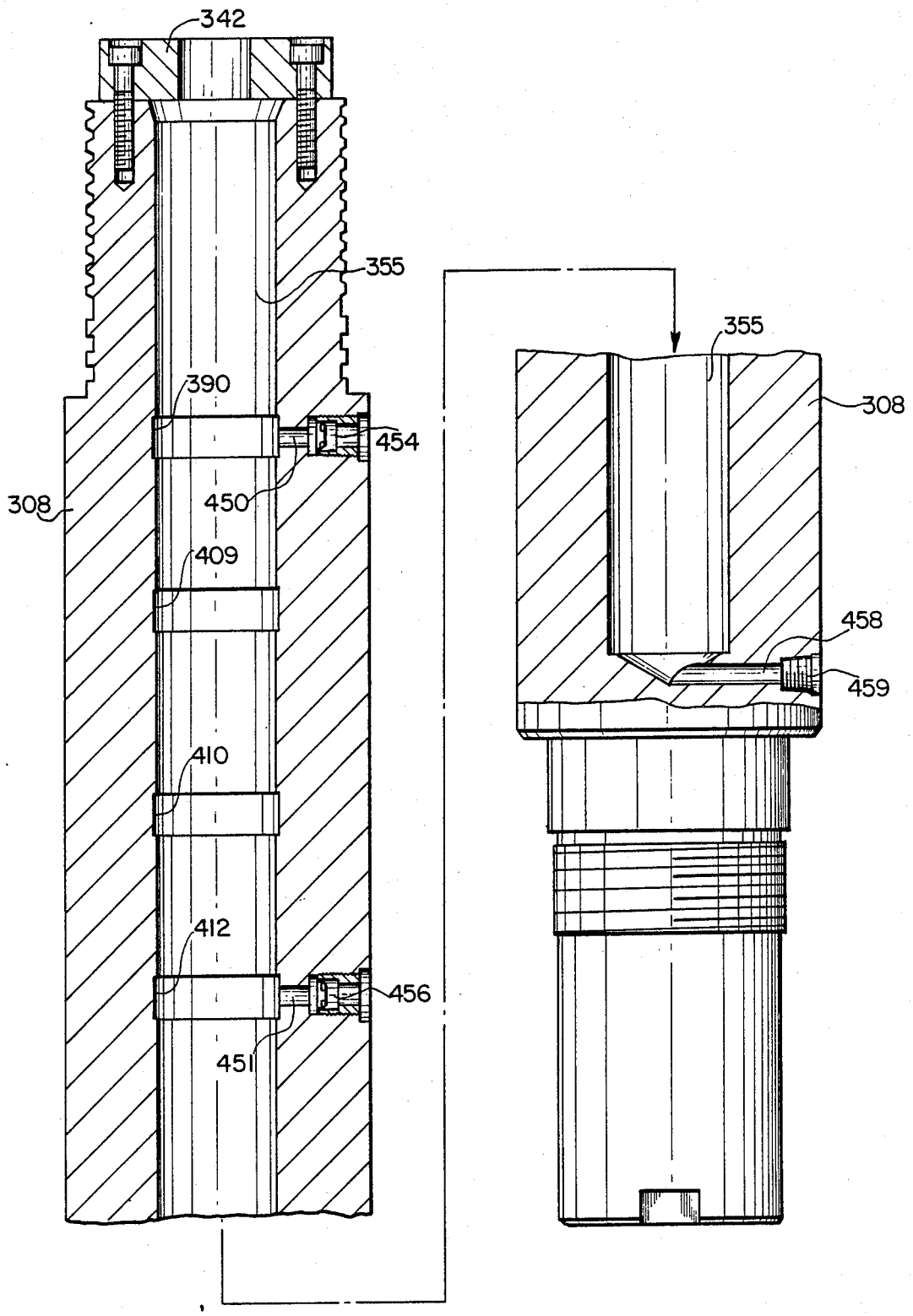
FIG. 21 is a sectional view taken along lines 21—21 of FIG. 7.

Valve body sleeve 350 is provided with a plurality of upper radial bores 352 as shown in FIG. 7 which are horizontally positioned in a common plane transverse to the axis A of valve body sleeve 350 and moveable valve spool member 334 as shown in FIGS. 5 and 6; the outer ends of bores 352 communicate with an annular chamber 390 (FIG. 21) formed of facing grooves in valve body sleeve 350 and valve housing 308. Similarly, a plurality of upper central horizontal bores 405 are provided at a location immediately below the bores 352 and communicate on their outer ends with an annular chamber 409 formed of facing grooves in sleeve 350 and housing 308. Lower central bores 407 similarly extend through valve body sleeve 350 and have outer ends communicating with an annular chamber 410 (FIGS. 5 and 9) formed of facing annular grooves in members 308 and 350. In like manner, lowermost radial bore 411 extend transversely through the valve body sleeve 350 as best shown in FIGS. 6 and 10; the outer end of bore 411 communicates with an annular chamber 412 (FIG. 21) formed in members 308 and 350 and the inner end communicates with moveable chamber C2 as shown in FIG. 6.

Valve body sleeve 350 also includes upper seals 386, 388 (FIG. 6) provided in its outer surface and engaging the bore 355 of valve housing 308. Additional seal means 392, 394, 396, 398, 399, 400, 402 and 404 are also provided in the outer surface of valve body 350 for sealing contact with the inner bore 355 of valve housing 308 as shown in FIGS. 5 and 6.

Figure 4:
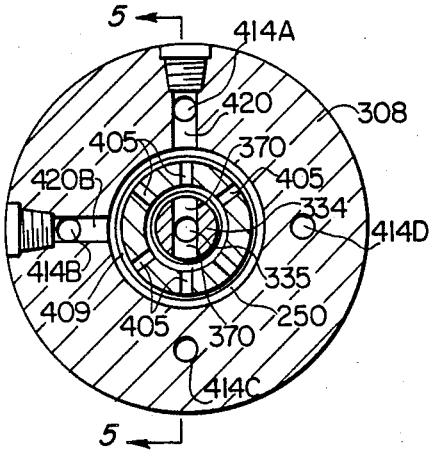
FIG. 4 is a sectional view taken along lines 4—4 of FIG. 22B.

Axially parallel bores 414A (FIG. 6), 414B (FIG. 22A), 414C (FIG. 5) and 414D (FIG. 22A) extend downwardly from the upper end of valve housing cylinder 308 and are all shown in FIG. 4 and are each provided with plug means at their upper ends for sealingly closing their upper ends. Bore 414A communicates with an upper radial bore 42OA having an inner end communicating with annular chamber 409 and has its lower end terminating at a lower radial bore 422A (FIG. 6). Similarly, axially parallel bore 414C communicates with an upper radial bore 416C (FIGS. 6 and 9) and a lower radial bore 422C (FIG. 6). The inner end of lower radial bore 422A communicates with the upper end of an axially parallel bore 424A which terminates on its lower end at a larger female coupling bore 428A which is dimensioned to receive a male coupling member 116A mounted on the upper end of upper connector sub 84 which is connected to valve housing cylinder 308 by the coupling sleeve 82 and a back-up ring 80. Similarly, other male flow connectors 116C, 116B and 116D are also mounted on the upper end of upper connector sub 84. Connector 116C is positioned in a female coupling bore 428C coaxially communicating with the lower end of an axially parallel bore 424C which has an upper end communicating with the lower radial bore 422C.

Similarly, axially parallel bore 414D communicates with an upper radial bore 416D (FIG. 22B) which has an inner end communicating with annular chamber 410; bore 414D also converts to a lower radial bore 422D at its lower end with lower radial bore 422D communicating with the upper end of an inwardly positioned axially parallel bore 424D which communicates on its lower end with female coupling bore 428D which is dimensioned and positioned to matingly receive male flow connector coupling member 116D. Similarly, axially parallel bore 414B communicates with upper radial bore 420B (FIG. 22B) and terminates at a lower radial bore 422B which is connected at its inner end to an inwardly positioned axially parallel bore 424B which terminates at its lower end in a female coupling bore 428B which is dimensioned and positioned to matingly receive male flow connector 116B.

A significant advantage of the present invention over the devices of the parent pending application and the Schellstede patent is that the axially parallel bores 414A, 414B, 414C and 414D are substantially shorter (25 inches as compared to 50 inches) than the corresponding bores of the devices of said application and patent. Consequently, substantial savings in machining expenses are achieved.

Valve housing cylinder 308 also includes exhaust bores 450 and 451 (FIG. 21) which respectively communicate on their inner ends with annular chambers 390 and 412. The outer ends of exhaust bores 450, 451 respectively communicate with check valves 454, 456 through which fluid can flow outwardly for discharge from housing 308 but which prevent the flow of liquid from outside the housing into bores 450 and 451. A pressure compensating bore 458 at the lower end of bore 355 is normally plugged by plug means at 459, however, the plug is removed for certain operations. If plug 459 is positioned in pressure compensating bore 458, the hydrostatic pressure in the string only acts on the upper end of the valve spool 334 to provide a force downwardly on the valve spool in a direction against the force of spring 312 so as to tend to overcome the spring and move the valve spool to its FIG. 6 position. Thus, a heavier spring might be required for deep wells in order to prevent the string hydrostatic pressure inside sub 300 from moving the valve spool 334 to its FIG. 6 position. However, by removing plug 459 from bore 458, this problem can be avoided in wells having fluid in the casing since such removal causes the hydrostatic pressure of fluid in the casing exterior of the housing to push upwardly on the lower end of the valve spool to at least partially counteract the downward force on the upper end caused by the hydrostatic pressure in the interior of sub 300. If the casing is full of fluid, the hydrostatic pressure in sub 300 will be fully counteracted. It is consequently frequently possible to avoid the need for replacing the coil spring for a particular job; a further advantage is that it is possible to calibrate the valve at the surface prior to lowering the tool down a well without there being any need to consider the effects of hydrostatic pressure.

Male coupling members 116A and 116C have their lower or base ends threaded into threaded openings in the upper end of an upper connector sub 84 in the upper end of the lance section as shown in FIG. 5; it should also be noted that the other male coupling members 116D and 116B are also mounted in the same manner on the upper end of connector sub 84 of the lance section. The use of the male couplers 116A etc. and female sockets 428A etc. provides a sure quick-coupling and leak-proof connection between the hydraulic circuits of the different sections of the apparatus with the use of O-rings or lip-type seals on male coupling members 116A through 116D insuring a positive seal. A very substantial advantage arises from the fact that one section of the tool can be easily replaced in the filed without a complete disassembly of the tool being necessary. Stated differently, the sections are simply disconnected and the new section easily substituted and the apparatus sections reconnected in an easy manner. During testing and operation of the device, if one section malfunctions, it can consequently be easily replaced with a minimum of difficulty. Also, transportation of the tool is much easier than was possible with the device of U.S. Pat. No. 4,640,362, since the longest component section is only 20 feet as compared to an overall length of 49 feet of the unitary assembly of the aforementioned patent.

The lower end of the main control housing 300 is connected to the upper end of the lance section by a back-up ring 80 (FIG. 5) threaded onto the outer surface of valve housing cylinder 308 and a coupling sleeve 82 connected at its lower end to a heavy threaded connector sleeve 110. Coupling sleeve 82 is fitted over the back-up ring 80 so that members 80 and 82 abut to preclude any additional downward movement of coupling sleeve 82.

Figure 3A:
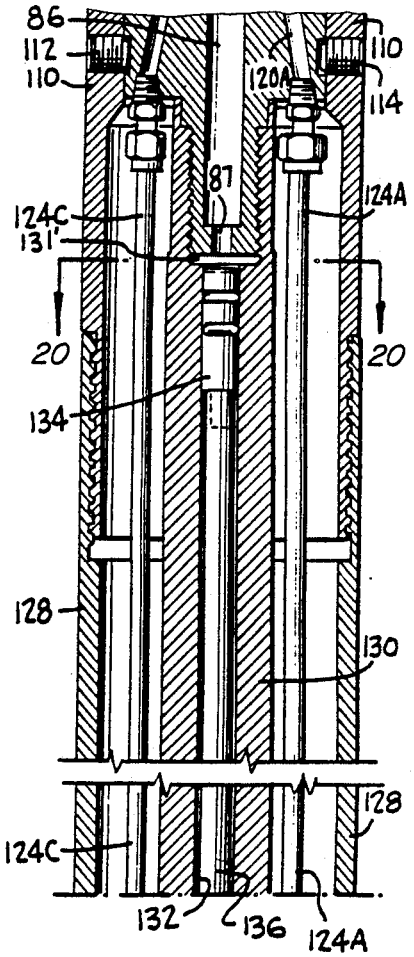
FIGS. 3C, 3D, 3E and 3F are sectional views taken along line 3—3 of FIG. 1 progressively from the top of the lance section to the bottom of the punch section of the apparatus as shown in FIG. 1 and with the parts in deactivated position prior to initiation of a penetration operation.

Turning now to the specifics of the lance section, attention is initially invited to FIG. 3A, which illustrates that the upper outer periphery of the lance section is defined by the heavy threaded connector sleeve 110 having external threads at its upper end threadably engaged with the coupling sleeve 82 and enclosing upper connector sub 84. The aforementioned upper connector sub 84 includes an axial bore 86 and a first pair of diametrically opposite slots which receive locking lugs 112 and 114 mounted in threaded bores in the wall of the connector sleeve 110 as shown in FIG. 3A. Male flow connectors 116A and 116C extend upwardly from the upper end of upper connector sub 84 and are positioned in female coupling bores 428A and 428C. The lower ends of male flow connectors 116A and 116C are in communication with canted bores 120A and 120C (FIG. 5), which are in turn respectively connected through conventional fittings to axially parallel conduits 124A and 124C, which extend downwardly in connector sleeve 110 and a tubular lance cylinder housing 128 as shown in FIG. 3A.

Figure 20:
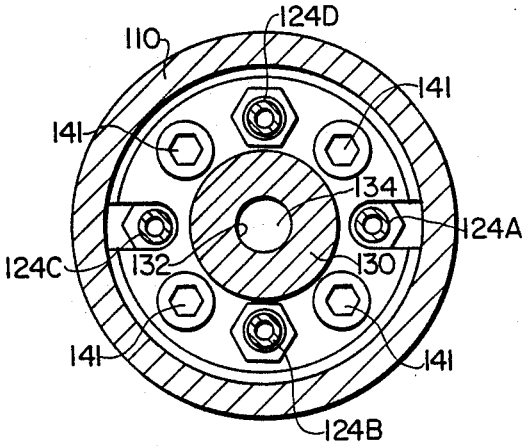
FIG. 20 is a sectional view taken along lines 20—20 of FIG. 3A.
Figure 13A:
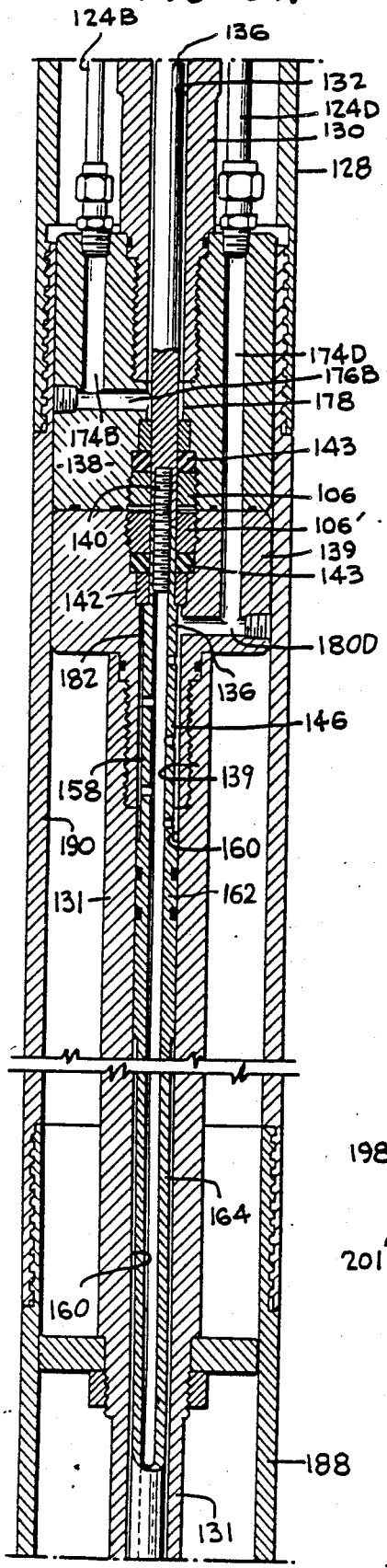
FIG. 13A is a sectional view taken along lines 13A—13A of FIG. 3B.

Similarly, the lower ends of female coupling bores 428D and 428B communicate through male coupling members 116D and 116B, respectively, and also communicate with canted bores in upper connector sub 84 which in turn communicate with the upper ends of conduits 124D and 124B (FIGS. 20 and 13A).

The tubular lance cylinder housing 128 is threadably mounted on the lower end of the heavy threaded connector sleeve 110 and extends downwardly therefrom. Additionally, an upper lance cylinder 130 is threadably connected to the lower end of the upper connector sub 84 and includes an upper chamber 131' communicating with axial bore 86 of sub 84 via a reduced diameter bore 87 in the lower end of sub 84 as shown in FIG. 3A. An upper lance drive piston 134 is mounted for reciprocation in an axial bore 132 extending downwardly from chamber 131' on the upper end of an upper piston rod component 136 positioned axially in bore 132. Piston 134 is made of monel. However, a stainless-steel piston with a brass sleeve has also proven to be satisfactory. It should be observed that there is a clearance between the bore 132 and the rod 136, the purpose of which will become apparent.

Figure 3B:
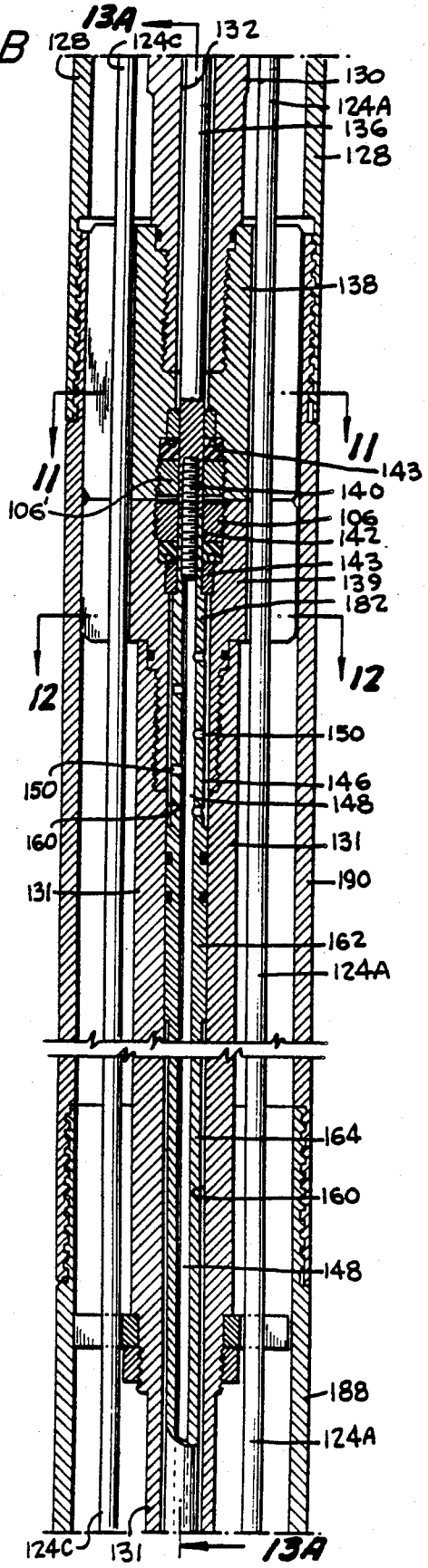
Figure 11:
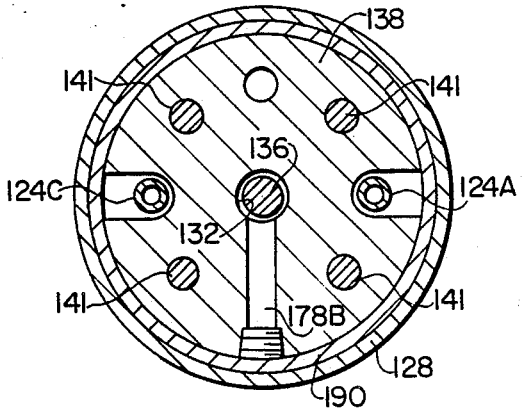
FIG. 11 is a sectional view taken along lines 11—11 of FIG. 3B.
Figure 12:
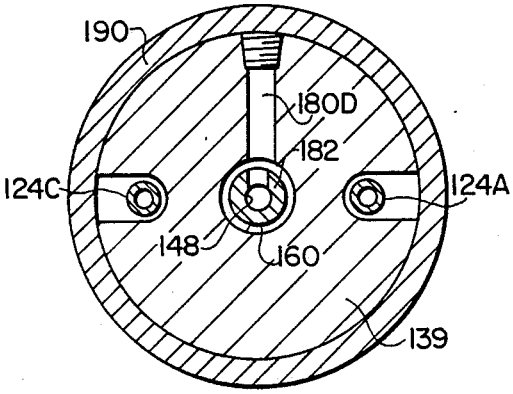
FIG. 12 is a sectional view taken along line 12—12 of FIG. 3B.

The lower end of upper lance cylinder 130 is threadably received in the upper end of an upper head block component 138 (FIG. 3D) and the lower end of upper piston rod component 136 is threadably connected to the upper end of a threaded rod connector 140 as shown in FIG. 3B. A lower lance cylinder 131 has its upper end connected to the lower end of lower head block component 139 Upper head block component 138 is connected to lower head block component 139 by four machine bolts 141 (FIG. 11) to provide a unitary head block assembly. It should also be observed that the head block components 138 and 139 are provided with slots on diametric opposite sides through which the lines 124C and 124A extend.

The upper end 142 of intermediate monel rod component 146 (FIG. 3B) is threaded on the lower end of the threaded rod connector 140. Rod component 146 has a larger diameter than upper end 142 and also has an axial bore 148. Radial bores 150 communicate axial bore 148 with the space 158 (FIG. 18) inside bore 182 of lower head block component 139 and bore 160 of lower lance cylinder 131 external of rod 146. It is of substantial importance that rod 146 is positioned within bores 182 and 160, which have a greater diameter than the outer diameter of rod 146. Consequently, liquid is free to pass through the radial bores 150 to or from the inner bore 148 and the space 158 (FIG. 18) between bores 182 and 160 and the outer surface of rod 146. However, lip seal members 143 are mounted in the upper and lower head blocks 138 and 139 by bushings 106 and 106' for providing a pressure tight seal between the bore 132 and the bore 160. Seal members 143 can be a lip seal with an O-ring expander to the type sold under the trademark POLYPAK by Parker Seal Corporation. The lower end of rod 146 is unitarily connected to a lower lance piston 162, which is matingly received within bore 160 for reciprocation therein.

The overall design of the reciprocating lance piston drive assembly allows for the piston rod to remain in tension during all operations of the tool. Because of the long stroke and smaller diameter of the piston, putting rod 146 into compressive load would cause buckling of the rod. By injecting fluid at the head block assembly 138, 139, etc., the extending and retracting pressure contacts the lower and upper lance pistons 162 and 134, respectively, from the rod side of the piston so that the piston rod 136 is always in tension and is never placed under compressive force.

Figure 19:
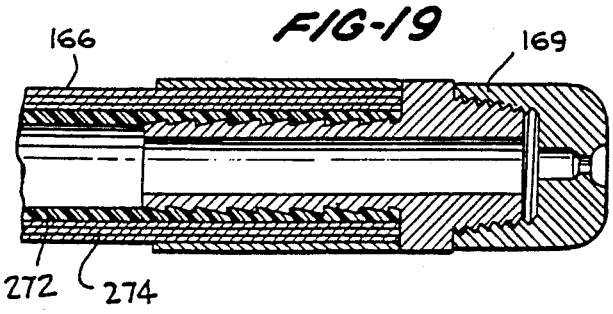
FIG. 19 is a bisecting sectional view of the nozzle employed in the preferred embodiment.
Figure 17:
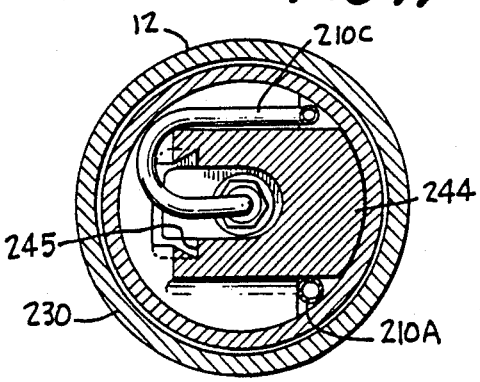
FIG. 17 is a sectional view taken along lines 17—17 of FIG. 14D.

A lance guide 168 (FIG. 3C) receives a lower piston rod 164 which has its lower end connected to the lance 166 formed of a teflon core 272 and outer threaded armored layers 274 of braided stainless-steel (FIG. 19). It should be understood that the term "lance" is used to refer to the semi-rigid extendable conduit and nozzle extension device member 166 and its associated actuating means. Thus, "lance" and "semi-rigid extendable conduit and nozzle extension device" are sometimes used interchangeably. Guide 168 has its lower end connected to a punch base 170 (FIG. 13C) having an internal lance guide passageway 172. A jet nozzle 169 is connected to the outer end of lance 166 for providing a cutting jet issuing from its outer end when high pressure fluid is provided in lance 166. Lance guide 168 has a small internal clearance of 1/32" between its inner surface and the outer surface of rod 164 and lance 166. Similarly, a clearance of approximately 1/32" is provided between bore 160 and the outer surface of rod 164. The aforementioned clearance prevents buckling of rod 164 and lance 166 when subjected to compression during extension of the lance in a penetration operation. It should also again be noted that the rod portions connecting pistons 134 and 162 are always maintained in tension due to pressure in bores 132 and 182 during operation of the device and are consequently never subjected to compression that might create a problem of buckling.

Figure 13B:
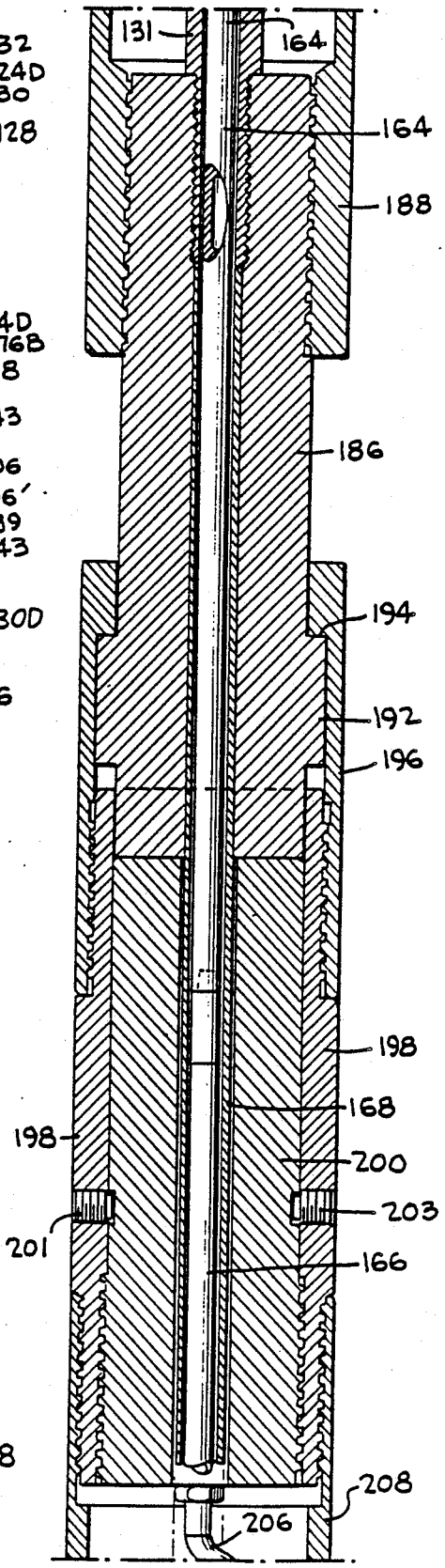
FIG. 13B is a sectional view taken along lines 13B—13B of FIG. 3C.
Figure 13C:
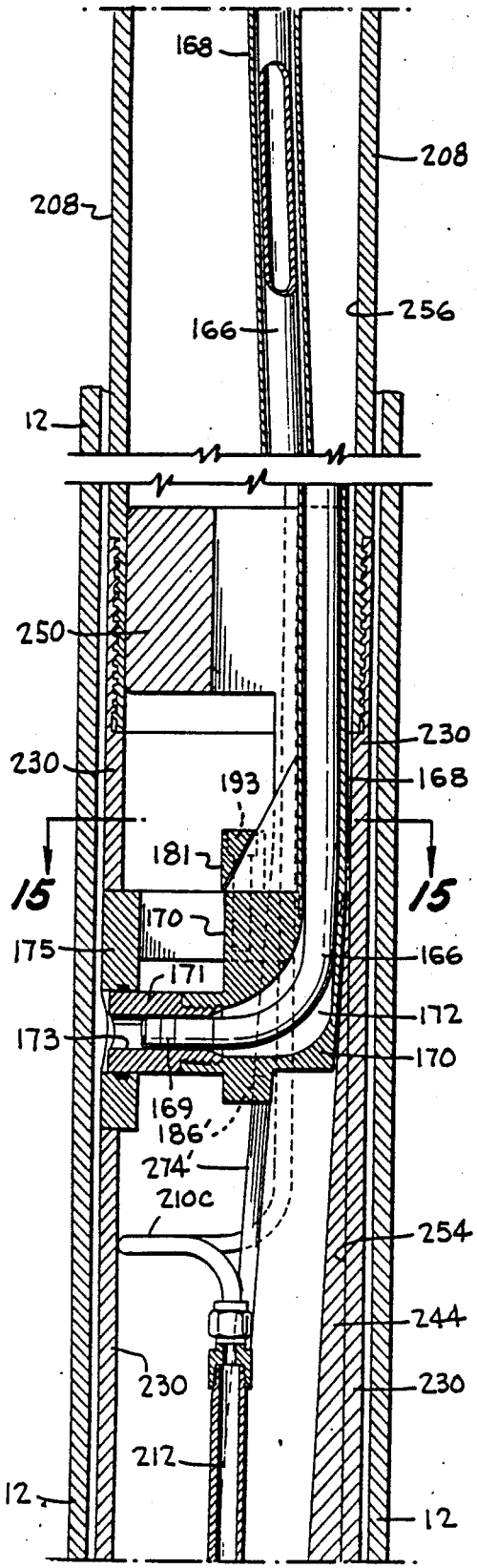
FIG. 13C is a sectional view taken along lines 13C—13C of FIG. 3D.

Punch base 170 has a tubular punch member 171 threaded into one side with the punch having a cylindrical guide bore 173 in which the nozzle 169 is positioned prior to actuation of the device as shown in FIG. 13C. Punch member 171 extends through an opening in a guide 175 of a cam enclosing housing 230 so that the punch member is capable of moving to and from the positions shown in FIGS. 13C and 14F. Movement of punch base 170 is limited to radial movement relative to housing 230 by fixedly positioned guide bars 177 and 179 attached to housing 230 and engaging a cross bar 181 attached to base 170 by bolts 193 and also engaging shoulders 183 and 185 on punch base 170. Longitudinal force from the punch drive piston 236 and punch drive cam 244 is transmitted into radial force through the shoulders 183 and 185 of the punch base to guide bars 177 and 179 and to punch 171 to effect punching of a hole in the casing well. The combined parts keep the punch aligned with the hole in the guide 175 of cam enclosing housing 230. Crossbar 181 prevents damage to the cam housing 230 by the punch base 170 in the event of the shearing of the punch. The punch base is always maintained in alignment with guide 175. The contacting surfaces of 177, 183 and 179, 185 are hardened to absorb the high pressures and forces to which they are subjected. Punch base 170 additionally includes hardened cam follower surfaces 186 and 189 engagable with hardened cam surfaces 245, 245', 247 and 247' of cam 244 for moving punch base 170 and punch 171 outwardly in response to upward movement of cam 244. Similarly, follower surfaces 191 engage facing surfaces of cam 244 to retract the punch 171 in response to downward movement of cam 244. The construction and interaction of the punch and cam 244, etc., is similar to that disclosed in U.S. Pat. No. 4,640,362 (Schellstede). However, the punch employs arcuate side slots 264 (FIG. 3D) as opposed to the rectangular slots 254 of the Schellstede patent. Also, the control circuitry is substantially different. The outer surface of the punch is hardened and it is machined so that its vertical cutting edge E is always vertical. The ratio of the outer diameter to the inner diameter of the punch must be such that the hole punched in the casing does not produce a plug punched out of the casing into the middle of the punch. The inner diameter edge of the punch is radiused to resist cutting of such a plug. Also, the angle of the punch surfaces are to be 45° from the horizontal axis.

It would also be possible to use a punch such as that described in our copending application Ser. No. 279,649 which is being executed and filed concurrently herewith and to which reference is specifically made.

Figure 18:
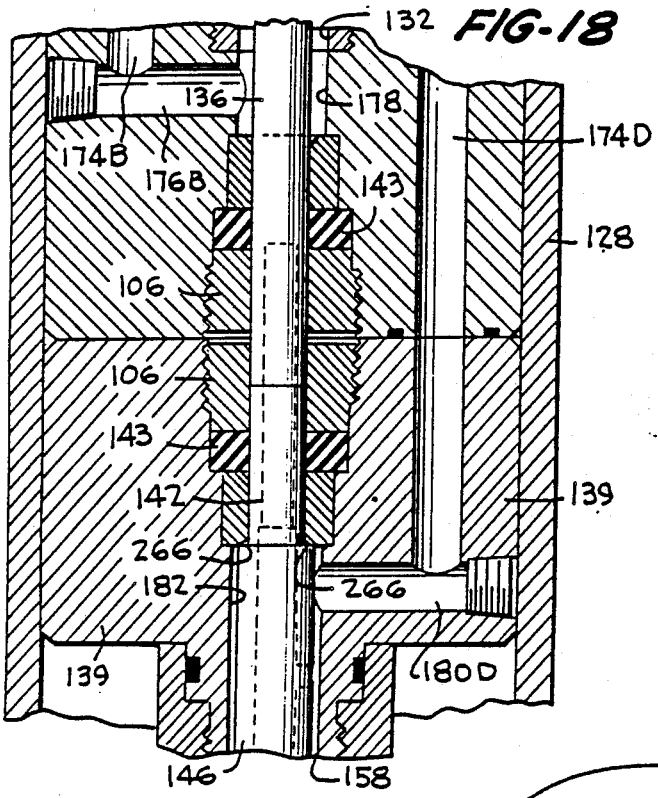
FIG. 18 is an enlarged view of a portion of FIG. 13A.

The lower ends of conduits 124B and 124D, respectively, communicate with axially parallel bores 174B and 174D as shown in FIGS. 13A and 18. Conduit 174B in turn communicates with a radial bore 176B, which has its inner end communicating with an axial bore 178 in upper head block component 138 through which the lower end of rod 136 extends with there being a clearance between bore 178 and the outer surface of rod 136. Consequently, radial bore 176B is in fluid communication with the space between bore 132 of upper lance cylinder 130 and the outer surface of rod 136 by virtue of the communication of bore 178 with bore 132 as shown. Similarly, the lower end of axially parallel bore 174D is connected to a radial bore 180D having an inner end communicating with a bore 182 in lower head block 139 surrounding and spaced from the upper end 142 of rod 146 as shown in FIG. 18.

The upper end of bore 182 terminates at an annular valve seat surface 266 against which the upper end of rod component 146 is engaged when the parts are in the positions illustrated in FIGS. 3B and 18. However, when the parts are in the position illustrated in FIG. 14A, radial bore 180D is placed in full communication with the space between bore 182 and the outer surface of rod 136. The lower end of the lower lance cylinder 131 is threadably received in an axial threaded socket in the upper end of a rigid lance carrier block 186 in which axially parallel bores 187C and 187A are respectively provided in alignment with conduits 124C and 124A as shown in FIG. 3C.

Figure 3C:
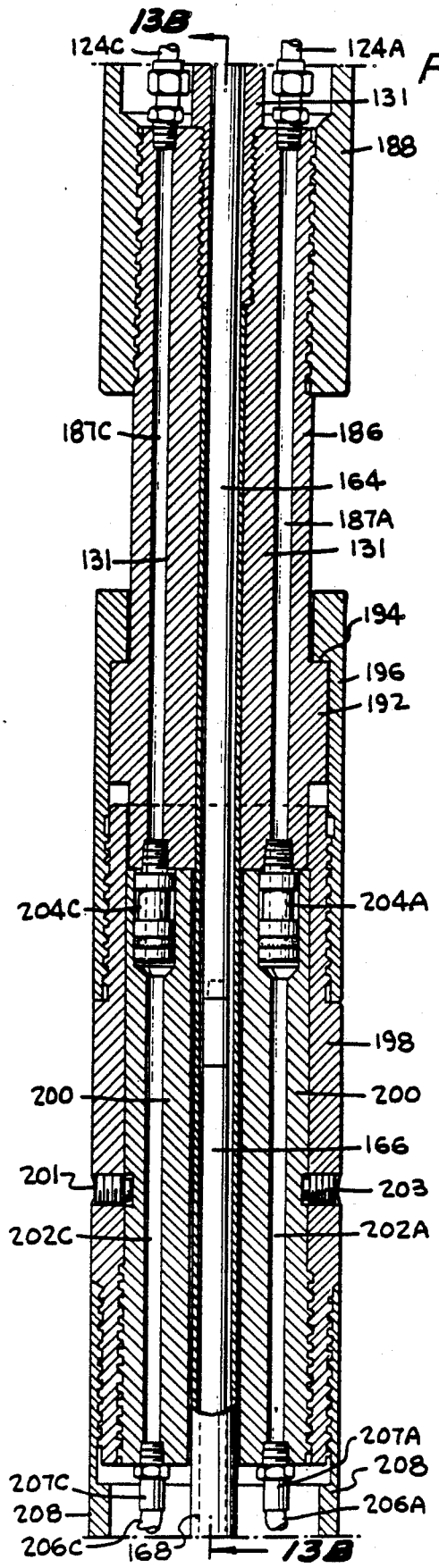

Additionally, it should be noted that the upper external periphery of the lance carrier block 186 is threadably received in the lower end of a tubular housing 188 (FIG. 3C). The upper end of tubular housing 188 is threadably received in the lower end of an intermediate tubular lance housing 190, which has an upper end threadably received in the lower end of the upper tubular lance cylinder housing 128. An annular flange 192 (FIG. 3C) extends outwardly from the lance carrier block 186 and provides a shoulder 194 engaged with a facing shouldering of a threaded tubular connector 196, which is in turn threaded onto the upper end of a punch cam housing 198.

Figure 3D:
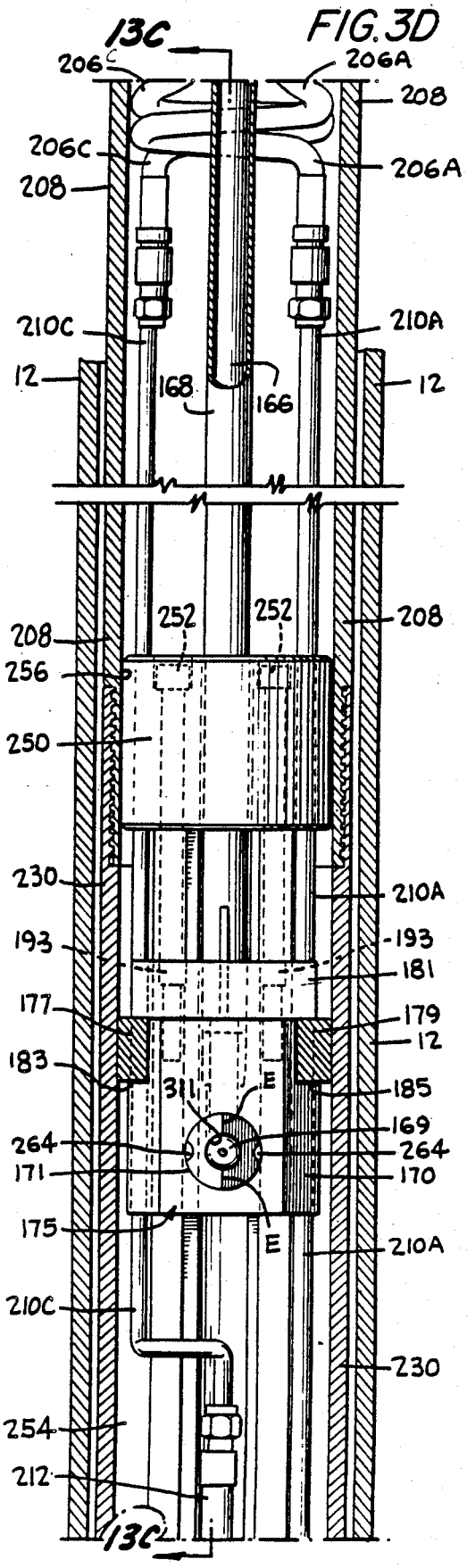

A lower lance carrier block 200 is threaded internally of the housing 198 with the lance guide tube 168 extending from carrier block 200 and with threaded lugs 201 and 203 holding block 200 in position as shown in FIG. 3C and similarly in FIG. 13B. Axially parallel bores 202C and 202A (FIG. 3C) extend along the length of lance carrier block 200 and communicate at their upper ends with bores 187C and 187A, respectively, through male connector members 204C and 204A mounted in the lower end of the lance carrier block 186. Additionally, flexible hose members 206A and 206C are respectively connected by coupling fittings 207A and 207C to the lower ends of bores 202A and 202C and extend downwardly in the wedge travel housing 208 threaded onto the lower end of the punch cam housing 198. Similarly, hose members 206C and 206A are connected at their lowermost ends to fixedly positioned conduits 210C and 210A as shown in FIG. 3D.

Figure 3E:
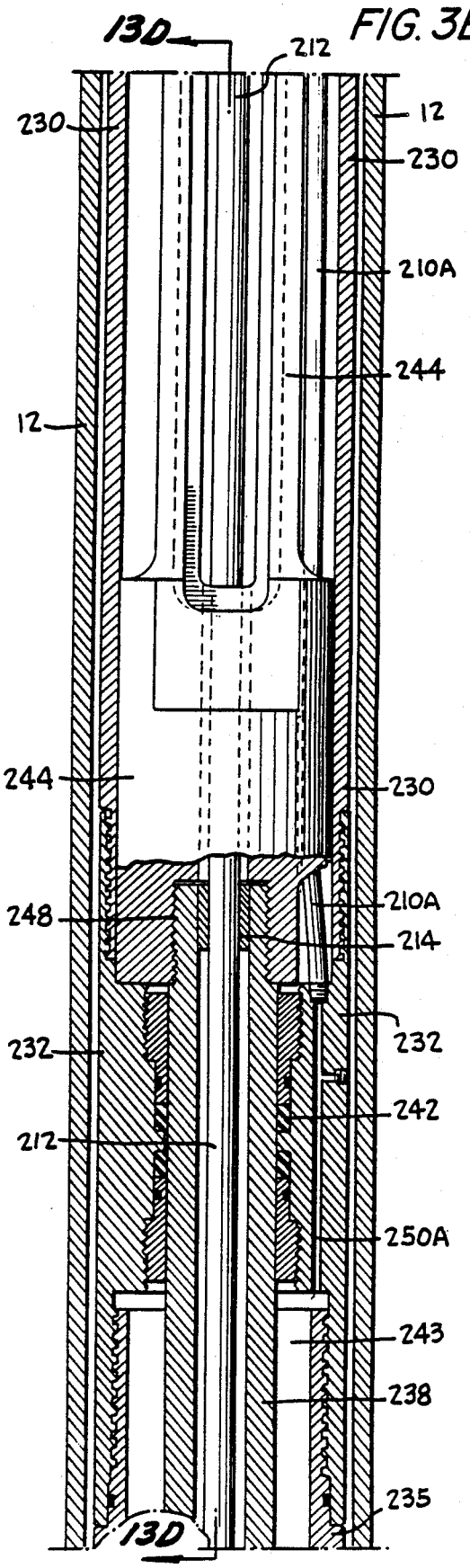
Figure 3F:
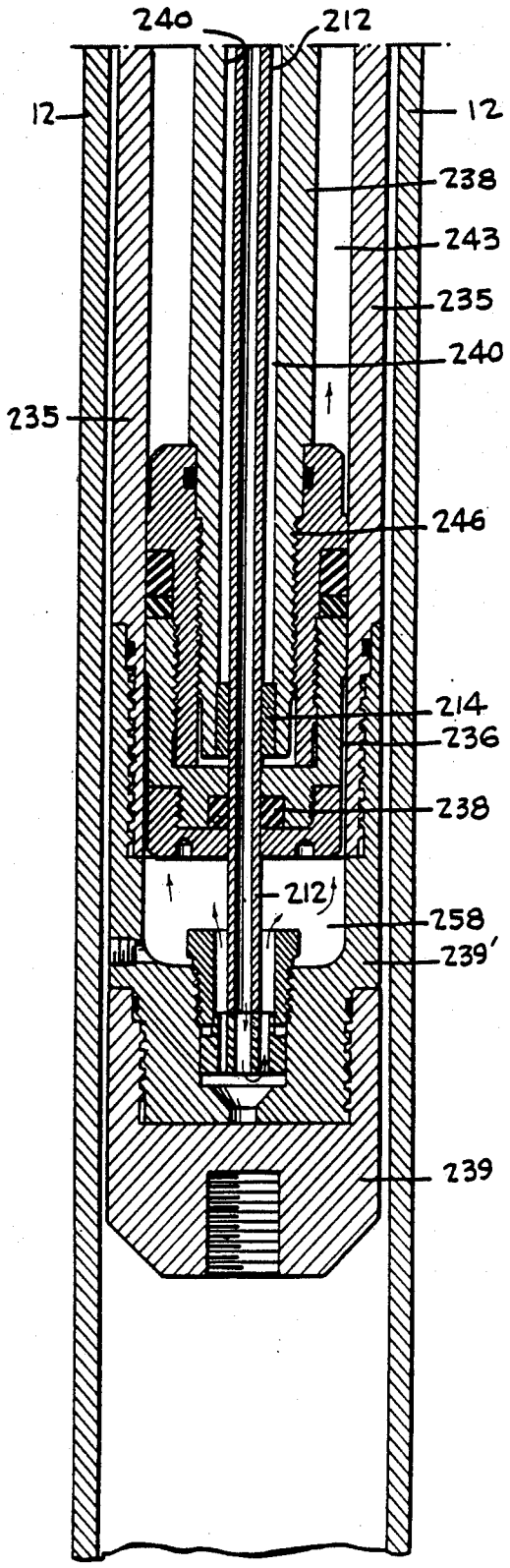

The lower end of conduit 210C is connected to a fixedly positioned hollow rod 212 extending through a cam enclosing housing 230 which extends downwardly from the lower end of housing 208. A rod guide head block 232 (FIG. 3E) is threaded on the lower end of housing 230 and a punch cam drive cylinder 235 is threaded to the head block 232 as shown in FIG. 3E.

Figure 13D:
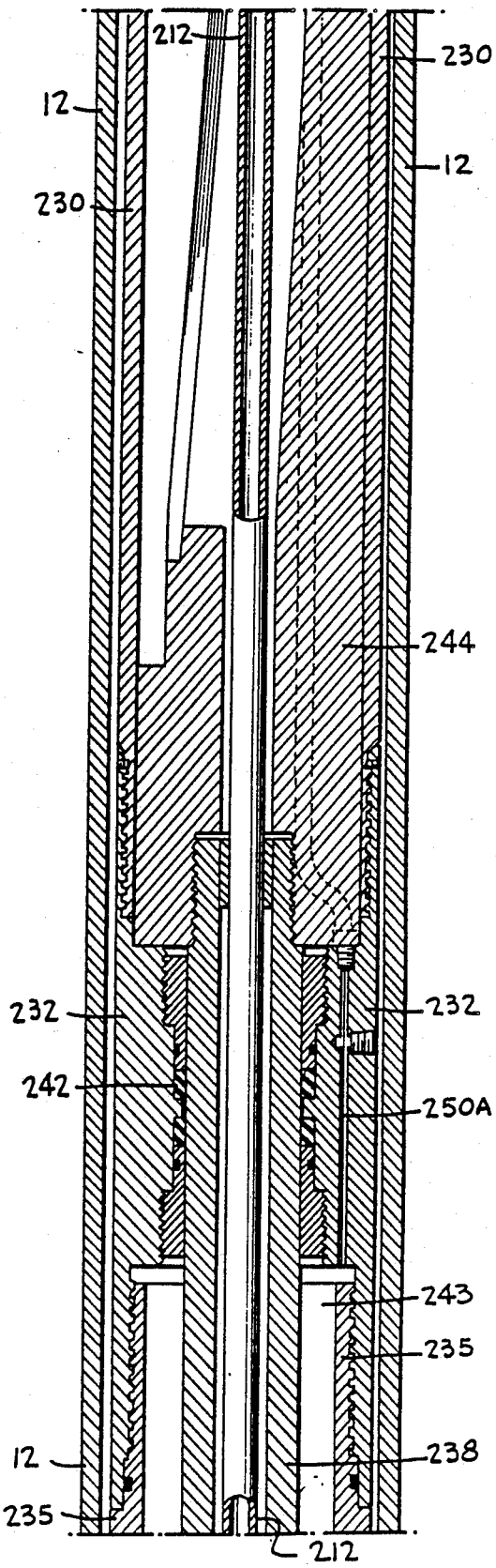
FIG. 13D is a sectional view taken along lines 13D—13D of FIG. 3E.

A punch drive piston 236 is mounted for reciprocation of the interior of cylinder 235 and includes an axial aperture through which the hollow rod 212 extends. It should be understood that piston 236 can reciprocate relative to rod 212 and that leakage from one side of the piston to the other side of the piston is precluded by virtue of seal means 238 engaging the outer surface of rod 212; also, brass bushings 214 engage rod 212. The aforementioned construction replaces the traveling hoses in the punch section of U.S. Pat. No. 4,640,362 to provide a much more durable and reliable construction. Moreover, assembly of the apparatus is much easier. It should also be observed that the rod 212 is mounted axially in a bore 240 in a punch cam drive rod 238 threaded at its lower end in punch drive cam 244 at 248 (FIG. 3E). Seal means 242 (FIG. 13D) in head block 232 engages rod 238 to prevent pressure leakage from the rod side chamber 243 of cylinder 235; also, multipurpose bore 250A (FIG. 3E) extends through head block 232 and has its lower end connected to rod side chamber 243 with its upper end being connected to the lower end of conduit 210A. A cam guide block 250 is attached to the upper end of cam 244 by machine bolts 252 and slidingly engages the bores 254 and 256, respectively, of housings 230 and 208. Guide block 250 assists the wedge in maintaining alignment during movement in either direction in preventing the wedge from cocking or lifting up off of cam enclosing housing 230 during retraction of the punch.

Figure 8:
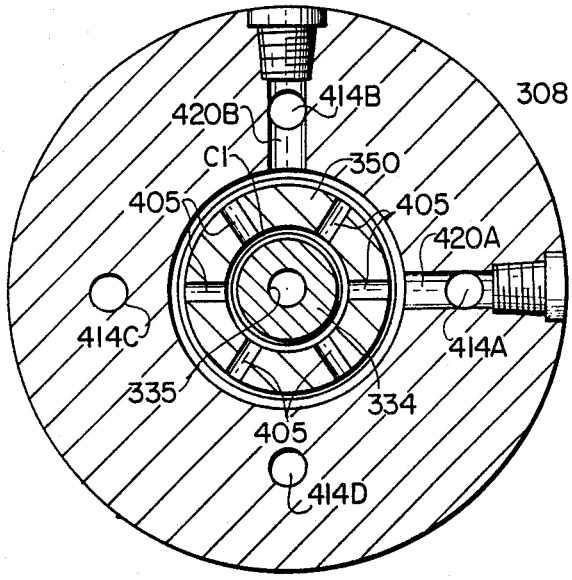
FIG. 8 is a sectional view taken along lines 8—8 of FIG. 6.

A cycle of operation will now be discussed with initial reference being made to FIGS. 2, 5 and 3A through 3F which illustrate the positions of the components prior to the initiation of penetration operation. The pressure acting downwardly on the valve spool 334 is less than that vertical pressure necessary to overcome the bias of spring 312; punch drive piston 236 is consequently restricted to its lowermost position but is ready to move upwardly to initiate movement of punch drive cam 244 and the resultant movement of the punch member outwardly to begin the punching operation. To start the operation, the pressure of the work fluid is increased to exceed the vertical pressure. Work fluid for moving the piston 236 during a penetration operation flows along path B comprising flow from male coupling member 116C, canted bore 120C, conduit 124C, bore 187C, coupling 204C, bore 202C, coupling 207C, hose 206C, conduit 210C and hollow rod 212 from the lower end of which it is discharged into the head (or lower) end chamber 258 of the punch drive cylinder to immediately initiate upward movement of piston 236, rod 238 and cam 244. Such flow is initiated by increasing the pressure of work fluid in string 22 which fills the space in bore 310 of housing 302 and bore 335 and acts on spool member 334 to urge it downwardly against the bias of spring 312. When the pressure of the work fluid reaches a predetermined value (the critical pressure), the force of spring 312 is overcome and valve spool 334 moves from its deactivated position in FIGS. 22A, 22B, and 5 to its activated position of FIG. 6. Positioning of valve spool 334 in its activated position causes work fluid to flow down spool bore 335, annular chamber 372, bores 407, annular chamber 410, bore 416C, downwardly in axially parallel bore 414C, bore 418C and bore 424C into male flow coupling 116C from which it flows to head end chamber 258 for initiating movement of piston 236 as discussed above. Exhaust fluid in rod side chamber 243 simultaneously flows upwardly through multipurpose bore 250A (FIG. 3E) into conduit 210A, hose 206A (FIG. 3D), bore 202A (FIG. 3C), flow connector 204A, bore 187A, conduit 124A, bore 120A (FIG. 3A), flow connector 116A, bore 424A, bore 422A, bore 414A, bore 420A (FIG. 8), annular chamber 409, bore 405, movable chamber C1, bores 352 (FIG. 7) annular chamber 390 and exhaust bore 450 from which it exhausts to the exterior of the housing through check valve 454.

Figure 14A:
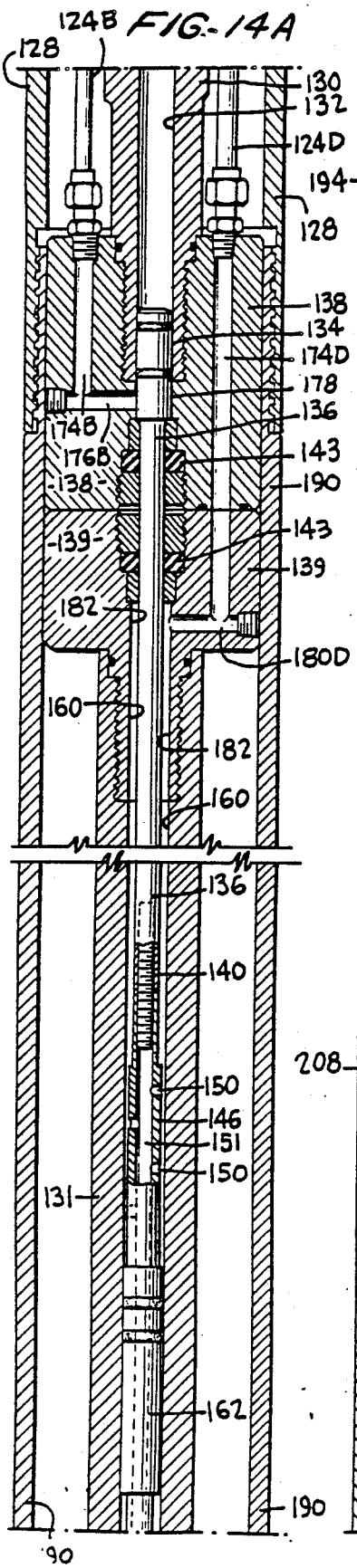
FIGS. 14A, 14B, 14C, 14D and 14E are sectional views taken along the same plane as FIGS. 13A etc., but illustrating the parts in an activated condition in which the formation penetration has been completed and formation injection is being performed with the views comprising progressively downward portions of the apparatus from the lance section to the lower end of the assembly.
Figure 14B:
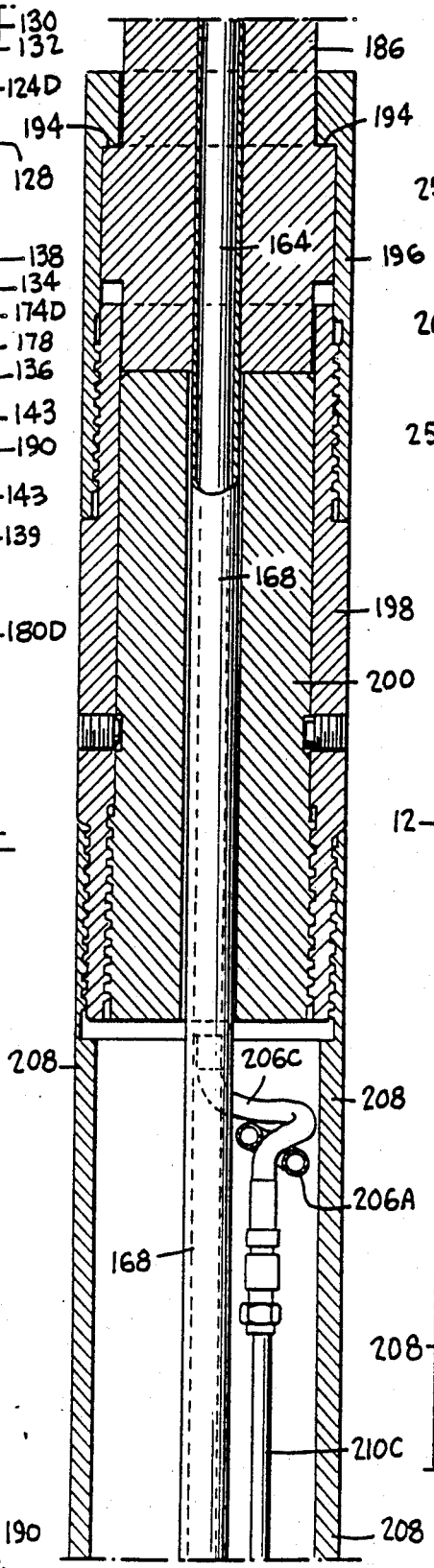
Figure 14C:
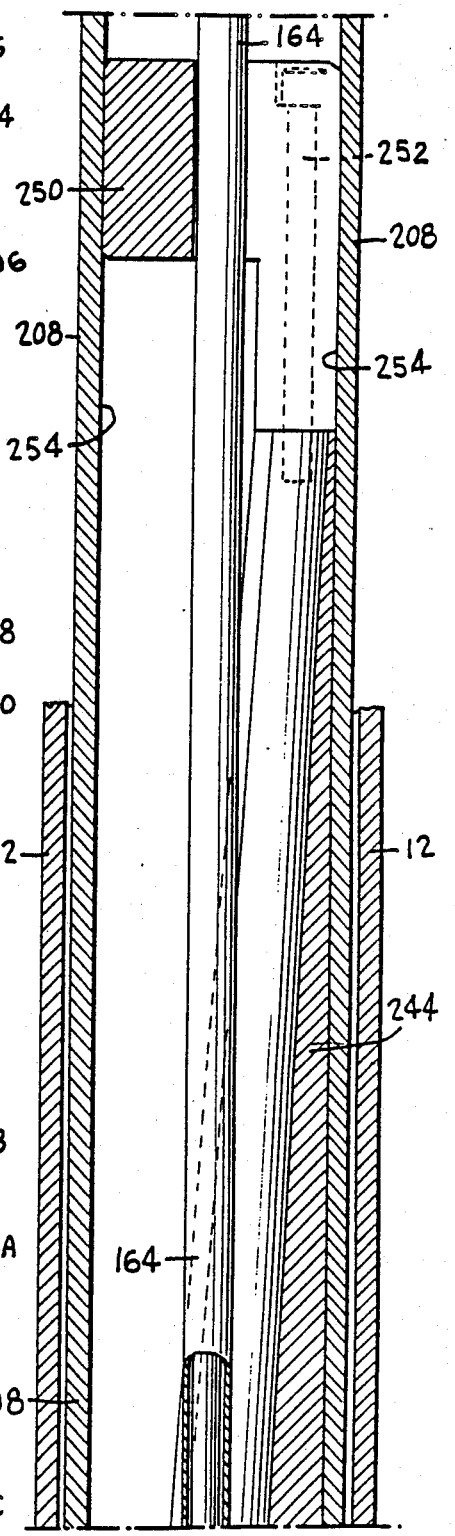
Figure 14D:
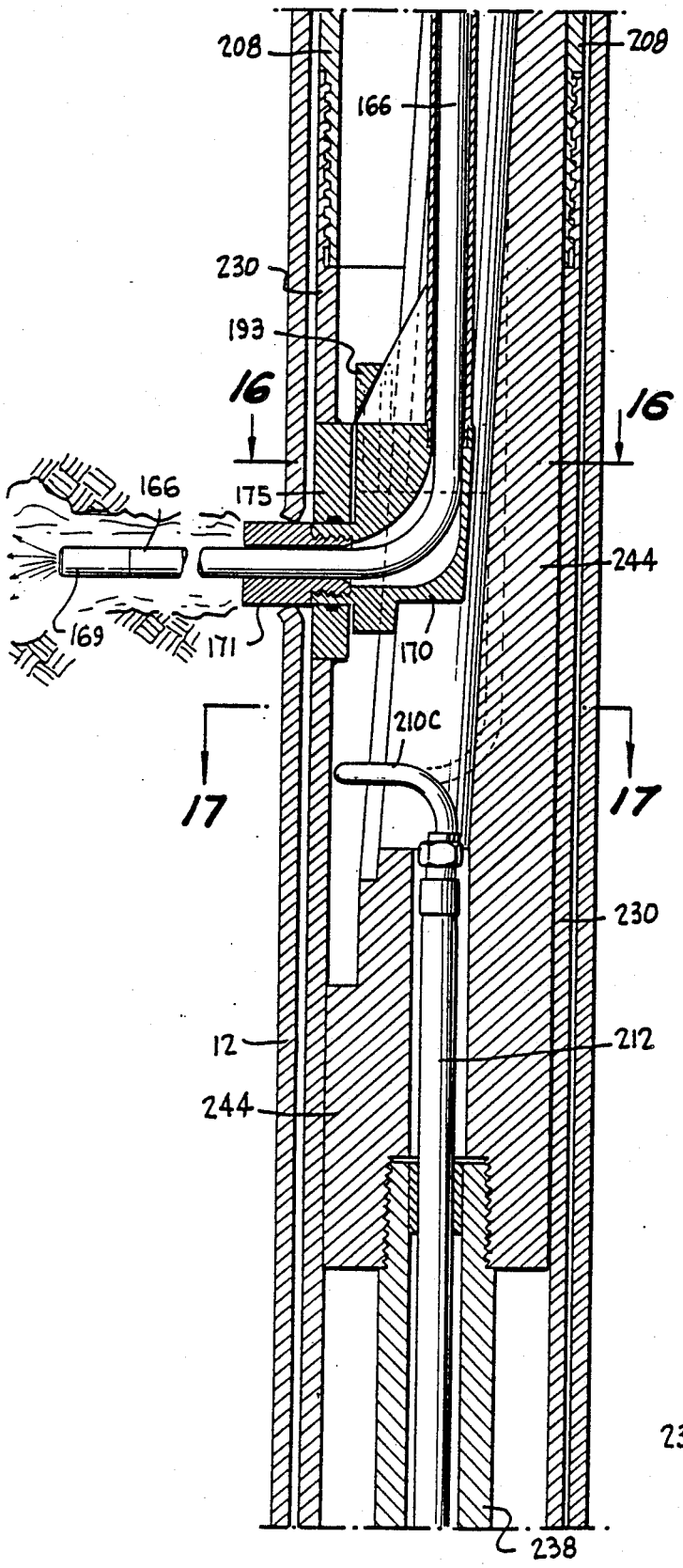
Figure 14E:
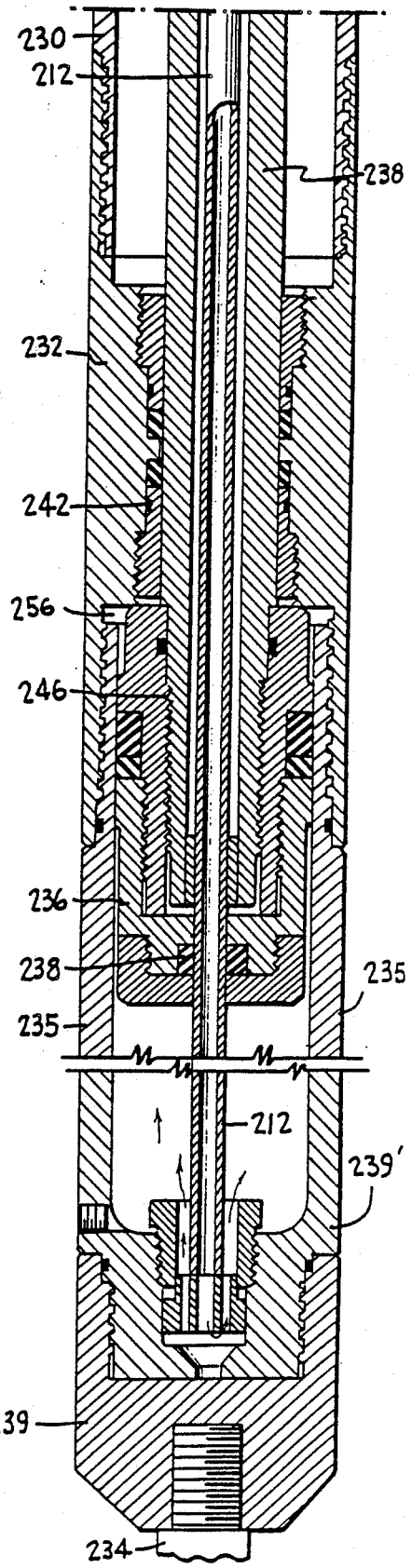
Figure 15:
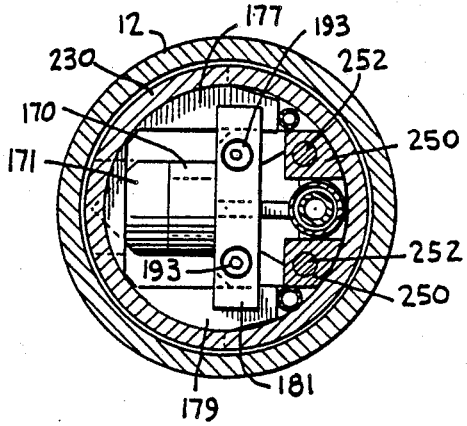
FIG. 15 is a sectional view taken along lines 15—15 of FIG. 13C.
Figure 16:
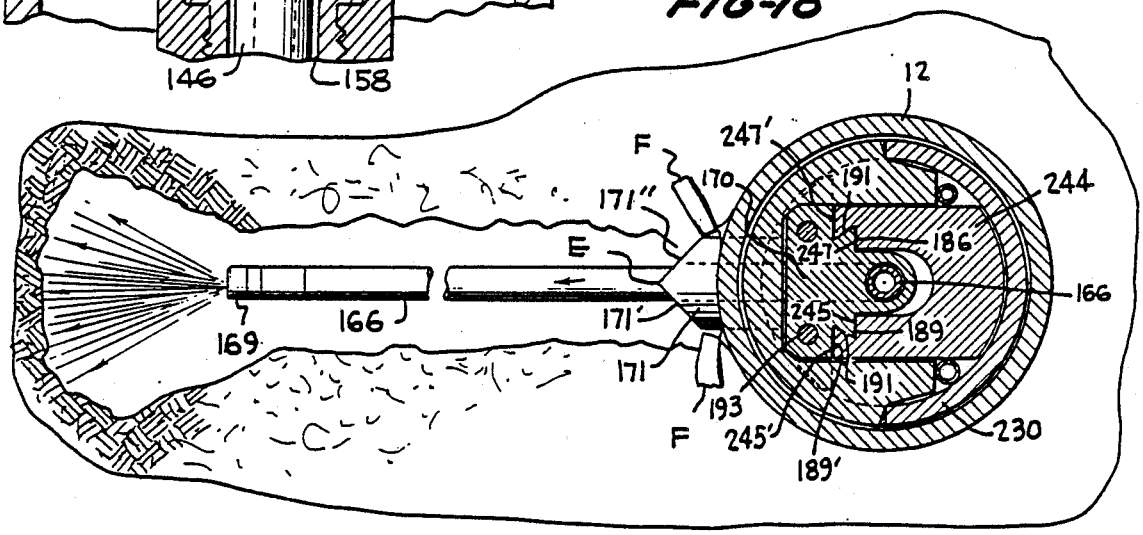
FIG. 16 is a sectional view taken along lines 16—16 of FIG. 14D.

The upward movement of cam 244 causes the cam to move the punch 171 from its retracted position illustrated in FIGS. 13C and 15 outwardly to its extended position illustrated in FIGS. 14D and 16 with such movement effecting the punching of a hole through casing 12 with the displaced portions of the casing solely comprising flaps F (FIG. 16) without there being any disconnection of any portion of the casing from the casing body. The outward movement of the punch 171 is accompanied by movement of nozzle 169 which subsequently moves outwardly from the nozzle end to cut an opening in the surrounding earth in a manner to be discussed.

Figure 2:
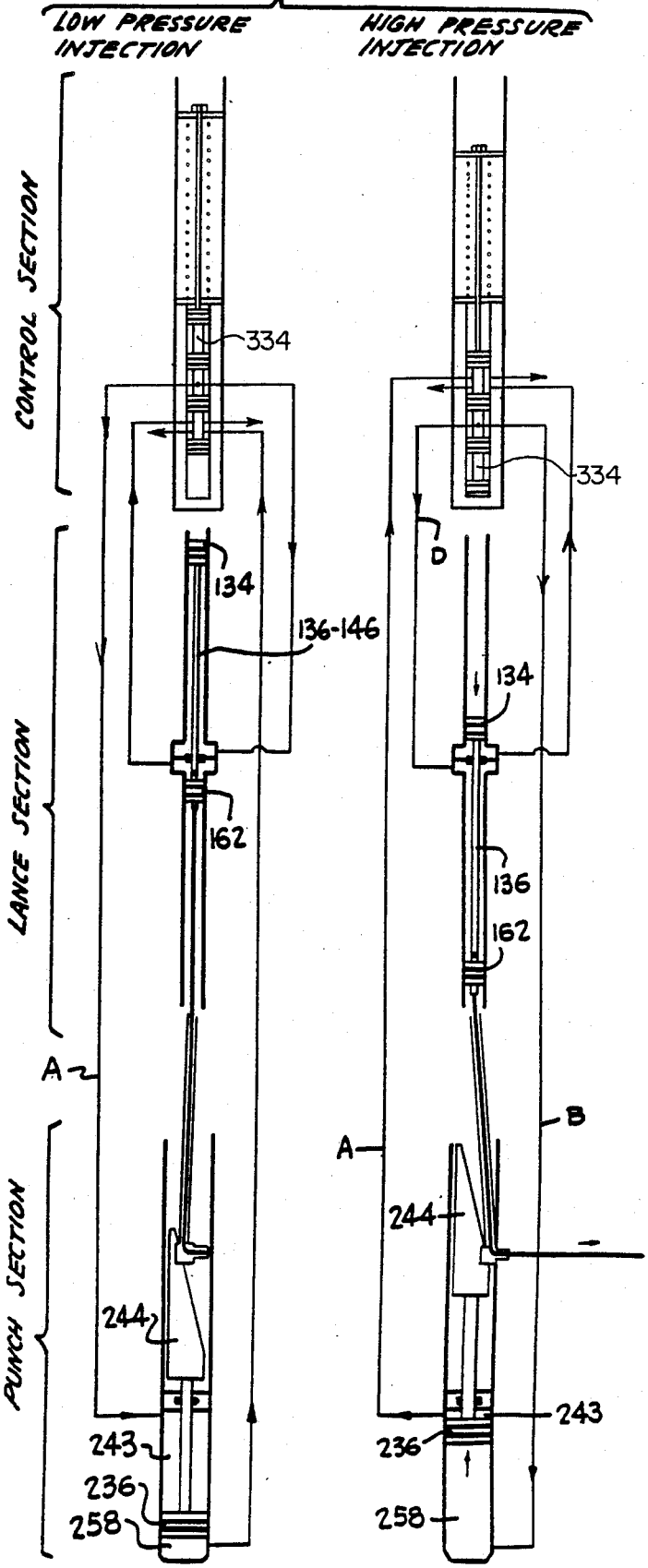
FIG. 2 is a flow diagram illustrating deactivated and activated modes of operation of the hydraulic circuitry and certain mechanical components of the invention.

The positioning of the moveable valve spool member 334 in its activated position of FIG. 6 also causes the flow of work fluid through bore 407, bore 416D (FIG. 9) and downwardly in bore 414D, coupling member 116D, canted bore 120D, conduit 124D, bore 174D and radial bore 180D into the bore 160. Fluid is permitted to flow downwardly into the upper end of bore 160 in the space between the bore and the outer surface of rod 136 as well as the space between the outer surface of the intermediate rod component 146 and bore 160 so that the lower lance piston 162 is urged downwardly with a small force which will cause the lance to move outwardly with the punch; simultaneously, fluid flows through the radial bores 150 into the axial passageway 151 (FIG. 14A). The fluid in passageway 151 flows downwardly into the axial passageway provided in member 164 from the lower end of which it enters the interior of lance 166 to begin the discharge of fluid from nozzle 169 in an obvious manner. The aforementioned composite flow path into bore 160 comprises path D as shown in FIG. 2. During penetration of the lance into the earth, the liquid and cuttings flow back past tabs F and through the slots 264 to drop into the annular space between the inner surface of the casing and the outer surface of the tool.

Figure 22A:
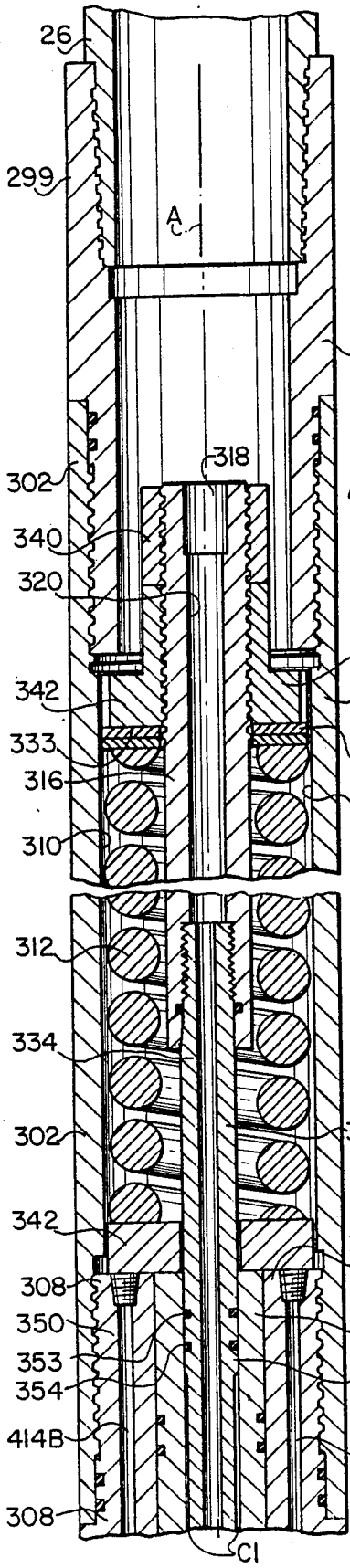
Figure 22B:
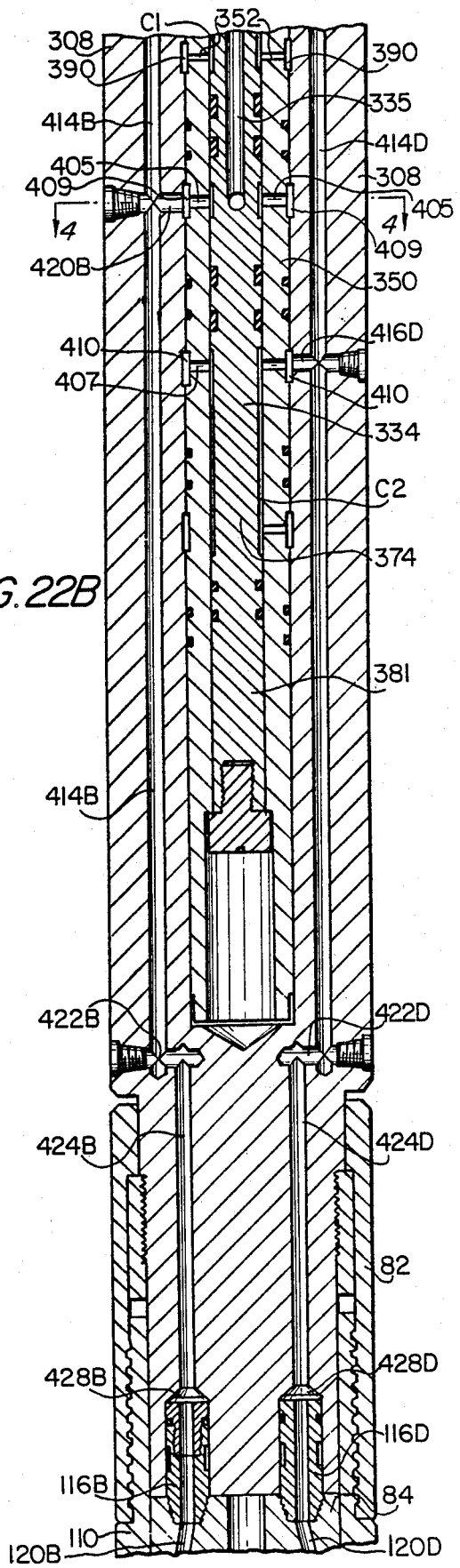

When the formation penetration operation is completed, the pump pressure is reduced sufficiently to permit the force of spring 312 to return the moveable valve spool member 334 to the position illustrated in FIGS. 22A and 5. Such movement results in the provision of working fluid flow to radial bore 176B (FIG. 14A) via bores 405, (FIG. 4) chamber 409, bore 420B, bore 414B, bore 422B (FIG. 22B), bore 424B, flow connector 116B, conduit 124B and bore 174B to act on the lower end of piston 134 to retract the lance to the positions illustrated in FIGS. 3A through 3D.

The return of moveable valve spool member 334 to the deactivated position illustrated in FIG. 22A also permits fluid to flow through path A (bore 405, chamber 409, bore 420A, bore 414A, bore 422A, bore 424A, flow connector 116A, bore 120A, conduit 124A, bore 187A, flow connector 204A, bore 202A, hose 206A, conduit 210A and bore 250A) to effect downward movement of piston 236 and cam 244 to retract punch 171 back into the housing to its FIG. 13C position. The fluid in chamber 258 of cylinder 235 is exhausted through hollow rod 212, conduit 210C, hose 206C, bore 202C, flow connector 204C, bore 131, conduit 124C, bore 120C, flow connector 116C, bore 424C, bore 422C, bore 414C, bore 416C, chamber 410, bore 407 and movable chamber C2 for discharge through bore 451 and check valve 456. The work fluid in bore 160 above piston 162 is exhausted through bore 180D, bore 174D etc. for discharge through check valve 456 to permit the upward movement of piston 162.

The cycle can be repeated a number of times to effect plural penetrations in the same producing zone. Following completion of all penetration operations a weighted rod is dropped down the drill string to break a shear pin in circulating valve 21 to permit the tubing string to be drained of all fluid so as to reduce the amount of force required to lift the string and the penetration apparatus upwardly from the well casing and to eliminate pulling a "wet string" of tubing which would flood the well site.

Component 236 is made of brass. All of the housing components are made of 4140 alloy steel; punch 171 is made of 505 tool steel and remaining metal components are stainless steel.

Another significant aspect of the invention resides in the fact that the punch faces 171' and 171'' are perpendicular to each other. Also, the ratio of the outer diameter of the punch to the inner diameter should not be less than 2.3 in order to obtain an opening in which flaps F of the casing are folded back along opposite sides of the opening. If a ratio less than approximately 2.3 is used, the center bore will simply cut out a "biscuit" that will remain in the bore of the punch and preclude extension of the nozzle and/or break the punch. Avoidance of the cutting of a "biscuit" from the casing is additionally made more likely by the fact that the intersection of the outer end of the internal bore with the punch faces is a rounded edge 311 while the outer diameter intersection 313 is a sharp edge. Rounded edge 311 also aids in centering the lance to ensure that the lance will be retracted completely inside the punch.

The preferred embodiment is sufficiently small to permit its use in 4 ½" O.D. casings, the smallest used in oil and gas wells. Prior known devices of the type disclosed in U.S. Pat. No. 4,640,362 could not be used in such small casings.

Numerous modifications of the preferred embodiment will undoubtedly occur to those of skill in the art. Therefore, it should be understood that the spirit and scope of the invention is to be limited solely to the appended claims.

We claim:

1. In a well penetrator of the type including housing means capable of being lowered down the interior of a well casing, a work fluid input means in said housing means, a movable punch member having an inner end and an outer end and being movable between a retracted position and an extended position, said outer end of said movable punch member including casing cutting means for cutting an opening in a casing when moved forcefully outwardly toward said extended position, punch support means supporting said punch member for movement relative to said housing means between said retracted position in which said outer end of said punch member is positioned substantially within the confines of said housing means and said extended position in which said outer end of said punch member is positioned outwardly of said housing means, power actuated punch drive means mounted in said housing means for selectively moving said punch member between its retracted and extended positions, high pressure lance means having nozzle means mounted on one end for movement in said punch member between a retracted position in which said nozzle means is positioned internally of said punch member and an extended position in which said nozzle means is positioned outwardly of said punch member for discharging a high pressure jet outwardly beyond the outer end of said punch member for cutting and removing the surrounding earth formation, lance positioning drive means mounted in said housing means for selectively moving said lance and nozzle toward their extended position and for retracting said lance and nozzle toward their retracted position, first punch work fluid supply means connected to said punch drive means for actuating said punch drive means to cause the punch to move toward its extended position, second punch work fluid supply means connected to said punch drive means for activating said punch drive means to move the punch toward its retracted position, first lance work fluid supply means connected to lance positioning drive means to cause movement of said nozzle toward its extended position, second lance work fluid supply means connected to said lance positioning drive means to cause said nozzle to move toward its retracted position, control valve means mounted in said housing means including a movable valve member mounted for movement between a first position in which said control valve means directs work fluid to said first punch work fluid supply means and said first lance work fluid supply means and a second position in which said control valve means directs work fluid to said second punch work fluid supply means and said second lance work fluid supply means, said movable valve means having a portion contacted by work fluid from said work fluid input means so that said movable valve member is urged toward said second position by the pressure of work fluid in said work fluid input means, the improvement comprising spring means for applying force to said moveable valve member for urging said movable valve member toward its first position in response to the pressure of said work fluid in said work fluid input means being below a predetermined critical value so that said punch means and said nozzle means are positioned in their retracted positions and for permitting said movable valve member to move its second position in response to the pressure of said work fluid in said work fluid input means exceeding said critical pressure.

2. A well penetrator as recited in claim 1 additionally including means for adjusting the force applied to said movable valve member by said spring means.

3. A well penetrator as recited in claim 2 wherein said spring means is a coil compression spring.

4. A well penetrator as recited in claim 3 wherein said movable valve member is a movable valve spool mounted for axial reciprocation in a valve housing.

5. A well penetrator as recited in claim 4 wherein said coil compression spring is mounted coaxially with respect to said moveable valve spool.

6. A well penetrator as recited in claim 5 additionally including a pressure compensating opening extending through said valve housing for communicating a portion of said movable valve spool with the exterior of said valve housing so that hydrostatic pressure exterior of said valve housing acts on said movable valve spool to urge said movable valve spool toward its first position so as to at least partially counteract the force exerted by hydrostatic pressure in said work fluid input means.

7. A well penetrator as recited in claim 6 wherein said coil compression spring has upper and lower ends with said lower end engaging the upper end of the valve housing and said valve spool includes an upper end extending coaxially up into said coil compression spring and a threaded connector on the upper end of said valve spool and wherein said means for adjusting the force applied to said valve spool comprises loading means threaded on said threaded connector and engaging said upper end of said coil compression spring so that said coil compression spring is compressed between said upper end of said valve housing and said loading means and said valve spool is urged upwardly by said coil compression spring and further including stop means for limiting upward movement of said valve spool to define said first position of said valve spool.

8. A well penetrator as recited in claim 1 wherein said valve member is a movable valve spool mounted for reciprocation in a valve housing and said spring means is a coil compression spring mounted coaxially with respect to said movable valve spool.

9. A well penetrator as recited in claim 8 additionally including a pressure compensating opening extending through said valve housing for communicating a portion of said movable valve spool with the exterior of said valve housing so that hydrostatic pressure exterior of said valve housing acts on said movable valve spool to urge said movable valve spool toward its first position so as to at least partially counteract the force exerted by hydrostatic pressure in said work fluid input means.

10. A well penetrator as recited in claim 9 wherein said coil compression spring has upper and lower ends with said lower end engaging the upper end of the valve housing and said valve spool includes an upper end extending coaxially up into said coil compression spring and a threaded connector on the upper end of said valve spool and wherein said means for adjusting the force applied to said valve spool comprises loading means threaded on said threaded connector and engaging said upper end of said coil compression spring so that said coil compression spring is compressed between said upper end of said valve housing and said loading means and said valve spool is urged upwardly by said coil compression spring and further including stop means for limiting upward movement of said valve spool to define said first position of said valve spool.

11. A well penetrator including an elongated vertically oriented housing capable of being supported by a pipe string and lowered down the interior of a well casing, work fluid receiving means in said housing for receiving work fluid from said pipe string, a movable punch member having an inner end and an outer end and being mounted for movement between a retracted position and an extended position, said outer end of said movable punch member including casing cutting means for cutting an opening in a casing when moved forcefully outwardly toward said extended position, punch support means supporting said punch member for transverse movement relative to said housing between said retracted position in which said outer end of said punch member is positioned substantially within the confines of said housing and said extended position in which said outer end of said punch member is positioned outwardly of said housing, fluid actuated punch drive means mounted in said housing for moving said punch member between its retracted and extended positions, high pressure lance means having nozzle means mounted on one end for movement in said punch member between a retracted position in which said nozzle means is positioned internally of said punch member and an extended position in which said nozzle means is positioned outwardly of said punch member for discharging a high pressure jet outwardly beyond the outer end of said punch member for cutting and removing the surrounding earth formation, lance positioning drive means mounted in said housing for moving said lance and nozzle means toward their extended position and for retracting said lance and nozzle means toward their retracted position, first punch work fluid supply means connected to said punch drive means for actuating said punch drive means to cause the punch to move toward its extended position, second punch work fluid supply means connected to said punch drive means for activating said punch drive means to move punch member to its retracted position, first lance work fluid supply means connected to lance positioning drive means to cause movement of said nozzle means toward its extended position, second lance work fluid supply means connected to said lance positioning drive means to cause said nozzle to move toward its retracted position, control valve means mounted in said housing including a movable valve member mounted for movement between a first position in which said control valve means directs work fluid to said first punch work fluid supply means and said first lance work fluid supply means and a second position in which said control valve means directs work fluid to said second punch work fluid supply means and said second lance work fluid supply means, said movable valve means having a portion contacted by work fluid from said work fluid receiving means so that said movable valve member is urged toward said second position by the pressure of work fluid in said work fluid receiving means, spring means mounted in said housing above said movable valve member for applying force to said moveable valve member for urging said movable valve member toward its first position in response to the pressure of said work fluid in said work fluid input means being below a predetermined critical value so that said punch means and said nozzle means are positioned in their retracted positions and for permitting said movable valve member to move to its second position in response to the pressure of said work fluid in said work fluid receiving means exceeding said critical pressure.

12. A well penetrator as recited in claim 11 additionally including loading means for adjusting the force applied to said movable valve member by said spring means.

13. A well penetrator as recited in claim 11 additionally including means for adjusting the force applied to said movable valve member by said spring means and wherein said spring means is a coil compression spring.

14. A well penetrator as recited in claim 13 wherein said movable valve member is a movable spool mounted for axial reciprocation in said housing.

15. A well penetrator as recited in claim 14 wherein said coil compression spring is mounted coaxially with respect to said movable valve spool.

16. A well penetrator as recited in claim 12 wherein said spring means is a coil compression spring, said movable valve member is a movable valve spool mounted for axial reciprocation in a valve housing cylinder in said housing, said coil compression spring is mounted coaxially with respect to said movable valve spool and additionally including a pressure compensating opening extending through said housing for communicating a portion of said moveable valve spool with the exterior of said housing so that hydrostatic pressure exterior of said housing acts on said movable valve spool to urge said movable valve spool toward its first position so as to at least partially counteract the force exerted by hydrostatic pressure in said work fluid receiving means.

17. A well penetrator as recited in claim 16 wherein said coil compression spring has upper and lower ends with said lower end engaging the upper end of a portion of said valve housing cylinder in which said movable valve spool is mounted and wherein said valve spool includes an upper end extending coaxially up into said coil compression spring and a threaded connector on the upper end of said valve spool and wherein said means for adjusting the force applied to said valve spool comprises loading means threaded on said threaded connector and engaging said upper end of said coil compression spring so that said coil compression spring is compressed between said upper end of said valve housing cylinder and said loading means and said valve spool is urged upwardly by said coil compression spring and further including stop means for limiting upward movement of said valve spool to define said first position of said valve spool.

18. A well penetrator as recited in claim 11 wherein said movable valve member is a movable valve spool mounted for movement in a valve housing cylinder in said housing and additionally including a pressure compensating opening extending through said housing for communicating a surface of said movable valve spool with the exterior of said housing so that hydrostatic pressure exterior of said housing acts on said movable valve spool to urge said movable valve spool toward its first position so as to at least partially counteract the force exerted by hydrostatic pressure in said work fluid receiving means.

19. A well penetrator as recited in claim 18 wherein said spring means is a coil compression spring having upper and lower ends with said lower end of said coil compression spring engaging the upper end of the valve housing cylinder and said valve spool includes an upper end extending coaxially up into said coil compression spring and further including a threaded connector on the upper end of said valve spool and wherein said means for adjusting the force applied to said valve spool comprises loading means threaded on said threaded connector and engaging said upper end of said coil compression spring so that said coil compression spring is compressed between said upper end of said valve housing cylinder and said loading means and said valve spool is urged upwardly by said coil compression spring.

20. A well penetrator as recited in claim 19 additionally including stop means on the lower end of said valve spool for engaging a fixed abutment in said housing for limiting upward movement of said valve spool.

21. A well penetrator including an elongated vertically oriented housing capable of being supported by a pipe string and lowered down the interior of a well casing, work fluid input means in said housing for receiving work fluid from said pipe string, a movable punch member having an inner end and an outer end and being mounted for movement between a retracted position and an extended position, said outer end of said movable punch member including casing cutting means for cutting an opening in a casing when moved forcefully outwardly toward said extended position, punch support means supporting said punch member for transverse movement relative to said housing between said retracted position in which said outer end of said punch member is positioned substantially within the confines of said housing and said extended position in which said outer end of said punch member is positioned outwardly of said housing, fluid actuated punch drive means mounted in said housing means for selectively moving said punch member between its retracted and extended positions, first punch work fluid supply means connected to said punch drive means for actuating said punch drive means to cause the punch member to move toward its extended position, second punch work fluid supply means connected to said punch drive means for activating said punch member drive means to move the punch member to its retracted position, control valve means mounted in said housing including a movable valve member mounted for movement between a first position in which said control valve means directs work fluid to said second punch work fluid supply means and a second position in which said control valve means directs work fluid to said first punch work fluid supply means, said movable valve means having a portion contacted by work fluid from said work fluid input means so that said movable valve member is urged toward said second position by the pressure of work fluid in said work fluid input means, spring means mounted in said housing above said movable valve member for applying force to said moveable valve member for urging said movable valve member toward its first position in response to the pressure of said work fluid in said work fluid input means being below a predetermined critical value so that said punch member is positioned in its retracted position and for permitting said movable valve member to move to its second position in response to the pressure of said work fluid in said work fluid input means exceeding said critical pressure.

22. A well penetrator as recited in claim 21 additionally including loading means for adjusting the force applied to said movable valve member by said spring means.

23. A well penetrator as recited in claim 21 additionally including means for adjusting the force applied to said movable valve member by said spring means and wherein said spring means is a coil compression spring.

24. A well penetrator as recited in claim 23 wherein said movable valve member is a movable spool mounted for axial reciprocation in said housing.

25. A well penetrator as recited in claim 24 wherein said coil compression spring is mounted coaxially with respect to said movable valve spool.

26. A well penetrator as recited in claim 22 wherein said spring means is a coil compression spring, said movable valve member is a movable valve spool mounted for axial reciprocation in a valve housing cylinder in said housing, said coil compression spring is mounted coaxially with respect to said movable valve spool and additionally including a pressure compensating opening extending through said housing for communicating a portion of said moveable valve spool with the exterior of said housing so that hydrostatic pressure exterior of said housing acts on said movable valve spool to urge said movable valve spool toward its first position so as to at least partially counteract the force exerted by hydrostatic pressure in said work fluid receiving means.

27. A well penetrator as recited in claim 26 wherein said coil compression spring has upper and lower ends with said lower end engaging the upper end of a portion of said valve housing cylinder in which said movable valve spool is mounted and wherein said valve spool includes an upper end extending coaxially up into said coil compression spring and a threaded connector on the upper end of said valve spool and wherein said means for adjusting the force applied to said valve spool comprises loading means threaded on said threaded connector and engaging said upper end of said coil compression spring so that said coil compression spring is compressed between said upper end of said valve housing cylinder and said loading means and said valve spool is urged upwardly by said coil compression spring and further including stop means for limiting upward movement of said valve spool to define said first position of said valve spool.

28. A well penetrator as recited in claim 21, additionally including a pressure compensating opening extending through said housing for communicating a surface of said movable valve member with the exterior of said housing so that hydrostatic pressure exterior of said housing acts on said movable valve member to urge said movable valve member toward its first position so as to at least partially counteract the force exerted by hydrostatic pressure in said work fluid receiving means on said movable valve member.

* * * * *